US007658698B2

(12) United States Patent
Pacheco et al.

(10) Patent No.: US 7,658,698 B2
(45) Date of Patent: Feb. 9, 2010

(54) VARIABLE STRIDE EXERCISE DEVICE WITH RAMP

(75) Inventors: Chad R. Pacheco, Colorado Springs, CO (US); Farid Farbod, Monument, CO (US); William T. Dalebout, North Logan, UT (US); Jaremy T. Butler, Paradise, UT (US)

(73) Assignee: Icon IP, Inc., Logan, UT (US)

( * ) Notice: Subject to any disclaimer, the term of this patent is extended or adjusted under 35 U.S.C. 154(b) by 0 days.

(21) Appl. No.: 11/832,496

(22) Filed: Aug. 1, 2007

(65) Prior Publication Data

US 2008/0032869 A1 Feb. 7, 2008

Related U.S. Application Data

(60) Provisional application No. 60/834,928, filed on Aug. 2, 2006, provisional application No. 60/908,915, filed on Mar. 29, 2007.

(51) Int. Cl.
*A63B 22/04* (2006.01)

(52) U.S. Cl. ..... 482/52

(58) Field of Classification Search ..... 482/1, 482/4–7, 51–53, 62, 70–71, 57; *A63B 22/04*
See application file for complete search history.

(56) References Cited

U.S. PATENT DOCUMENTS

| | | | | |
|---|---|---|---|---|
| 3,316,898 | A | | 5/1967 | Brown |
| 3,501,140 | A | | 3/1970 | Eichorn |
| 3,622,179 | A | * | 11/1971 | Pfersick ..... 280/207 |
| 3,756,595 | A | | 9/1973 | Hague |
| 3,824,994 | A | | 7/1974 | Soderberg, Sr. |
| 3,941,377 | A | | 3/1976 | Lie |
| 4,140,312 | A | | 2/1979 | Buchmann |
| 4,300,760 | A | | 11/1981 | Bobroff |

(Continued)

FOREIGN PATENT DOCUMENTS

| | | |
|---|---|---|
| DE | 229712 | 1/1911 |

(Continued)

OTHER PUBLICATIONS

Geartrends Fitness 2007 edition, available on information and belief at least as early as Jun. 1, 2007 (6 pages).

(Continued)

*Primary Examiner*—Loan H Thanh
*Assistant Examiner*—Oren Ginsberg
(74) *Attorney, Agent, or Firm*—Workman Nydegger

(57) ABSTRACT

A non-impact exercise device comprising a framework, at least one ramp assembly, a pair of foot support assemblies, a foot location control assembly, and means for adjusting the maximum stride length of the foot support assemblies. The foot support assemblies may advantageously be coupled to the foot location control assembly by a flexible cable linkage. The foot support assemblies each include a foot platform for the user to stand on. The foot support assemblies are coupled to the one or more ramp assemblies of the exercise device. The user exercises by putting force into the device through the foot platforms and/or handles. This causes the foot platforms to roll along the ramps while the user is standing upon the foot platforms. The user may readily vary the length and frequency of the reciprocating stride.

61 Claims, 19 Drawing Sheets

U.S. PATENT DOCUMENTS

| | | | | | |
|---|---|---|---|---|---|
| 4,340,214 | A | * | 7/1982 | Schutzer | 482/51 |
| 4,354,675 | A | | 10/1982 | Barclay | |
| 4,679,787 | A | | 7/1987 | Guilbault | |
| 4,708,338 | A | | 11/1987 | Potts | |
| 4,720,093 | A | | 1/1988 | Del Mar | |
| 4,938,474 | A | | 7/1990 | Sweeney et al. | |
| 5,013,031 | A | | 5/1991 | Bull | |
| 5,039,088 | A | | 8/1991 | Shifferaw | |
| 5,078,389 | A | | 1/1992 | Chen | |
| 5,135,447 | A | | 8/1992 | Robards, Jr. et al. | |
| 5,180,351 | A | * | 1/1993 | Ehrenfried | 482/52 |
| 5,195,935 | A | | 3/1993 | Fencel | |
| 5,199,931 | A | * | 4/1993 | Easley et al. | 482/52 |
| D336,141 | S | | 6/1993 | Husted et al. | |
| 5,242,343 | A | * | 9/1993 | Miller | 482/57 |
| 5,267,922 | A | * | 12/1993 | Robinson | 482/53 |
| 5,279,529 | A | | 1/1994 | Eschenbach | |
| 5,279,531 | A | | 1/1994 | Jen-Huey | |
| D344,112 | S | | 2/1994 | Smith | |
| 5,290,211 | A | | 3/1994 | Stearns | |
| 5,299,993 | A | | 4/1994 | Habing | |
| 5,308,296 | A | * | 5/1994 | Eckstein | 482/5 |
| 5,322,491 | A | | 6/1994 | Wanzer et al. | |
| 5,336,141 | A | | 8/1994 | Vittone | |
| 5,352,169 | A | | 10/1994 | Eschenbach | |
| 5,383,829 | A | | 1/1995 | Miller | |
| D356,128 | S | | 3/1995 | Smith et al. | |
| 5,415,607 | A | | 5/1995 | Carpenter | |
| 5,419,751 | A | | 5/1995 | Byrd et al. | |
| 5,423,729 | A | | 6/1995 | Eschenbach | |
| 5,435,799 | A | | 7/1995 | Lundin | |
| 5,435,801 | A | | 7/1995 | Hung | |
| D367,689 | S | | 3/1996 | Wilkinson et al. | |
| 5,499,956 | A | | 3/1996 | Habing et al. | |
| 5,518,473 | A | * | 5/1996 | Miller | 482/57 |
| 5,527,245 | A | | 6/1996 | Dalebout et al. | |
| 5,527,246 | A | | 6/1996 | Rodgers | |
| 5,529,554 | A | | 6/1996 | Eschenbach | |
| 5,529,555 | A | | 6/1996 | Rodgers, Jr. | |
| 5,540,637 | A | | 7/1996 | Rodgers, Jr. | |
| 5,549,526 | A | | 8/1996 | Rodgers, Jr. | |
| 5,562,574 | A | * | 10/1996 | Miller | 482/51 |
| 5,573,480 | A | | 11/1996 | Rodgers, Jr. | |
| 5,577,985 | A | | 11/1996 | Miller | |
| 5,591,107 | A | * | 1/1997 | Rodgers, Jr. | 482/57 |
| 5,593,371 | A | | 1/1997 | Rodgers, Jr. | |
| 5,593,372 | A | | 1/1997 | Rodgers, Jr. | |
| 5,595,553 | A | | 1/1997 | Rodgers, Jr. | |
| 5,595,556 | A | | 1/1997 | Dalebout et al. | |
| 5,611,756 | A | | 3/1997 | Miller | |
| 5,611,757 | A | | 3/1997 | Rodgers | |
| 5,611,758 | A | | 3/1997 | Rodgers | |
| 5,616,103 | A | | 4/1997 | Lee | |
| 5,626,542 | A | | 5/1997 | Dalebout et al. | |
| 5,637,058 | A | | 6/1997 | Rodgers | |
| D380,509 | S | | 7/1997 | Wilkinson et al. | |
| 5,653,662 | A | | 8/1997 | Rodgers, Jr. | |
| D384,118 | S | | 9/1997 | Deblauw | |
| 5,672,140 | A | | 9/1997 | Watterson et al. | |
| 5,683,333 | A | | 11/1997 | Rodgers, Jr. | |
| 5,685,804 | A | | 11/1997 | Whan-Tong et al. | |
| 5,690,589 | A | | 11/1997 | Rodgers, Jr. | |
| 5,695,434 | A | | 12/1997 | Dalebout et al. | |
| 5,695,435 | A | | 12/1997 | Dalebout et al. | |
| 5,707,320 | A | | 1/1998 | Yu | |
| 5,707,321 | A | | 1/1998 | Maresh | |
| 5,722,922 | A | | 3/1998 | Watterson et al. | |
| 5,738,614 | A | | 4/1998 | Rodgers, Jr. | |
| 5,743,834 | A | | 4/1998 | Rodgers, Jr. | |
| 5,755,642 | A | | 5/1998 | Miller | |
| 5,766,113 | A | | 6/1998 | Rodgers, Jr. | |
| 5,772,558 | A | | 6/1998 | Rodgers, Jr. | |
| 5,779,599 | A | | 7/1998 | Chen | |
| 5,782,722 | A | | 7/1998 | Sands et al. | |
| 5,788,609 | A | | 8/1998 | Miller | |
| 5,788,610 | A | | 8/1998 | Eschenbach | |
| 5,792,026 | A | | 8/1998 | Maresh et al. | |
| 5,792,029 | A | * | 8/1998 | Gordon | 482/52 |
| 5,795,268 | A | | 8/1998 | Husted | |
| 5,813,949 | A | | 9/1998 | Rodgers, Jr. | |
| 5,823,917 | A | | 10/1998 | Chen | |
| 5,830,113 | A | | 11/1998 | Coody et al. | |
| 5,830,114 | A | | 11/1998 | Halfen et al. | |
| 5,833,582 | A | | 11/1998 | Chen | |
| 5,836,854 | A | | 11/1998 | Kuo | |
| D403,033 | S | | 12/1998 | Husted et al. | |
| 5,846,166 | A | | 12/1998 | Kuo | |
| 5,855,538 | A | * | 1/1999 | Argabright | 482/70 |
| 5,857,941 | A | | 1/1999 | Maresh et al. | |
| 5,860,893 | A | | 1/1999 | Watterson et al. | |
| 5,860,895 | A | | 1/1999 | Lee | |
| 5,873,608 | A | | 2/1999 | Tharp et al. | |
| 5,897,460 | A | | 4/1999 | McBride et al. | |
| 5,899,834 | A | | 5/1999 | Dalebout et al. | |
| 5,904,637 | A | | 5/1999 | Kuo | |
| 5,911,649 | A | | 6/1999 | Miller | |
| 5,913,751 | A | | 6/1999 | Eschenbach | |
| 5,916,064 | A | | 6/1999 | Eschenbach | |
| 5,919,118 | A | | 7/1999 | Stearns et al. | |
| 5,924,962 | A | | 7/1999 | Rodgers, Jr. | |
| 5,938,567 | A | | 8/1999 | Rodgers, Jr. | |
| 5,938,570 | A | | 8/1999 | Maresh | |
| 5,944,638 | A | | 8/1999 | Maresh et al. | |
| 5,947,872 | A | | 9/1999 | Ryan et al. | |
| 5,951,449 | A | | 9/1999 | Oppriecht | |
| 5,957,814 | A | | 9/1999 | Eschenbach | |
| 5,961,423 | A | | 10/1999 | Sellers | |
| 5,997,445 | A | | 12/1999 | Maresh et al. | |
| 6,001,046 | A | | 12/1999 | Chang | |
| 6,004,244 | A | | 12/1999 | Simonson | |
| 6,007,462 | A | | 12/1999 | Chen | |
| 6,019,710 | A | | 2/2000 | Dalebout | |
| 6,024,676 | A | | 2/2000 | Eschenbach | |
| 6,027,431 | A | | 2/2000 | Stearns et al. | |
| 6,030,319 | A | | 2/2000 | Wu | |
| 6,030,320 | A | | 2/2000 | Stearns et al. | |
| 6,042,512 | A | | 3/2000 | Eschenbach | |
| 6,045,487 | A | | 4/2000 | Miller | |
| 6,077,202 | A | | 6/2000 | Gray | |
| 6,099,439 | A | | 8/2000 | Ryan et al. | |
| 6,106,439 | A | | 8/2000 | Boland | |
| 6,123,649 | A | | 9/2000 | Lee et al. | |
| 6,123,650 | A | | 9/2000 | Birrell | |
| 6,135,927 | A | | 10/2000 | Lo | |
| 6,146,313 | A | | 11/2000 | Whan-Tong et al. | |
| 6,149,551 | A | | 11/2000 | Pyles et al. | |
| 6,165,107 | A | * | 12/2000 | Birrell | 482/70 |
| 6,171,217 | B1 | | 1/2001 | Cutler | |
| 6,176,814 | B1 | | 1/2001 | Ryan et al. | |
| 6,190,289 | B1 | | 2/2001 | Pyles et al. | |
| 6,196,948 | B1 | | 3/2001 | Stearns et al. | |
| 6,206,804 | B1 | | 3/2001 | Maresh | |
| 6,210,305 | B1 | | 4/2001 | Eschenbach | |
| 6,217,486 | B1 | | 4/2001 | Rosenow | |
| 6,248,044 | B1 | | 6/2001 | Stearns et al. | |
| 6,261,209 | B1 | | 7/2001 | Coody | |
| 6,277,055 | B1 | | 8/2001 | Birrell et al. | |
| 6,315,702 | B1 | | 11/2001 | Ikonomopoulos | |
| 6,338,698 | B1 | | 1/2002 | Stearns et al. | |
| 6,361,476 | B1 | | 3/2002 | Eschenbach | |
| 6,368,252 | B1 | | 4/2002 | Stearns | |
| 6,390,953 | B1 | | 5/2002 | Maresh et al. | |
| 6,398,695 | B2 | | 6/2002 | Miller | |
| 6,409,632 | B1 | | 6/2002 | Eschenbach | |

| | | | | |
|---|---|---|---|---|
| 6,422,976 | B1 | 7/2002 | Eschenbach | |
| 6,422,977 | B1 | 7/2002 | Eschenbach | |
| 6,436,007 | B1 | 8/2002 | Eschenbach | |
| 6,440,042 | B2 | 8/2002 | Eschenbach | |
| 6,482,132 | B2 | 11/2002 | Eschenbach | |
| 6,500,096 | B1 | 12/2002 | Farney | |
| 6,544,147 | B1 | 4/2003 | Wang et al. | |
| 6,551,217 | B2 | 4/2003 | Kaganovsky | |
| 6,582,343 | B2 | 6/2003 | Lin et al. | |
| 6,612,969 | B2 | 9/2003 | Eschenbach | |
| 6,645,125 | B1 | 11/2003 | Stearns et al. | |
| 6,685,607 | B1 | 2/2004 | Olson | |
| 6,695,749 | B2 | 2/2004 | Kuo | |
| 6,730,002 | B2 | 5/2004 | Hald et al. | |
| 6,749,540 | B1 | 6/2004 | Pasero et al. | |
| 6,752,744 | B2 | 6/2004 | Arnold et al. | |
| 6,758,790 | B1 | 7/2004 | Ellis | |
| 6,783,481 | B2 | 8/2004 | Stearns et al. | |
| 6,786,850 | B2 | 9/2004 | Nizamuddin | |
| 6,821,232 | B1 | 11/2004 | Wang et al. | |
| 6,830,538 | B2 | 12/2004 | Eschenbach | |
| 6,855,093 | B2 | 2/2005 | Anderson et al. | |
| 6,875,160 | B2 | 4/2005 | Watterson et al. | |
| 6,905,441 | B2 | 6/2005 | Anderson | |
| 6,949,053 | B1 | 9/2005 | Stearns et al. | |
| 6,949,054 | B1 | 9/2005 | Stearns et al. | |
| 6,994,657 | B1 | 2/2006 | Eschenbach | |
| 7,025,711 | B2 | 4/2006 | Eschenbach | |
| 7,033,305 | B1 | 4/2006 | Stearns et al. | |
| 7,052,439 | B2 | 5/2006 | Anderson et al. | |
| 7,060,005 | B2 | 6/2006 | Carlsen et al. | |
| 7,097,592 | B2 | 8/2006 | Wang | |
| 7,097,600 | B2 * | 8/2006 | Gray | 482/71 |
| 7,153,238 | B2 | 12/2006 | Anderson et al. | |
| 7,156,776 | B2 * | 1/2007 | Maser | 482/52 |
| 7,169,087 | B2 | 1/2007 | Ercanbrack et al. | |
| 7,192,388 | B2 | 3/2007 | Dalebout et al. | |
| 7,201,707 | B1 | 4/2007 | Moon | |
| 7,214,167 | B2 | 5/2007 | Stearns et al. | |
| 7,214,168 | B2 * | 5/2007 | Rodgers, Jr. | 482/52 |
| 7,278,955 | B2 | 10/2007 | Giannelli et al. | |
| D554,715 | S | 11/2007 | Giannelli et al. | |
| D563,489 | S | 3/2008 | Giannelli et al. | |
| D564,051 | S | 3/2008 | Giannelli et al. | |
| 7,494,449 | B2 * | 2/2009 | Eschenbach | 482/57 |
| 2002/0019298 | A1 | 2/2002 | Eschenbach | |
| 2002/0086779 | A1 | 7/2002 | Wilkinson | |
| 2002/0198084 | A1 | 12/2002 | Stearns et al. | |
| 2003/0045403 | A1 | 3/2003 | Watterson et al. | |
| 2003/0083177 | A1 | 5/2003 | Tung | |
| 2003/0092532 | A1 | 5/2003 | Giannelli et al. | |
| 2004/0077463 | A1 | 4/2004 | Rodgers, Jr. | |
| 2004/0132583 | A1 | 7/2004 | Ohrt et al. | |
| 2004/0157706 | A1 | 8/2004 | Miller | |
| 2004/0162191 | A1 | 8/2004 | Ercanbrack et al. | |
| 2004/0198561 | A1 | 10/2004 | Corbalis et al. | |
| 2004/0224825 | A1 | 11/2004 | Giannelli et al. | |
| 2005/0009668 | A1 | 1/2005 | Savettiere et al. | |
| 2005/0026752 | A1 | 2/2005 | Lull et al. | |
| 2005/0085344 | A1 | 4/2005 | Eschenbach | |
| 2005/0101463 | A1 | 5/2005 | Chen | |
| 2005/0130807 | A1 | 6/2005 | Cutler et al. | |
| 2005/0164837 | A1 | 7/2005 | Anderson et al. | |
| 2005/0181912 | A1 | 8/2005 | Eschenbach | |
| 2005/0202939 | A1 | 9/2005 | Lull et al. | |
| 2005/0209059 | A1 | 9/2005 | Crawford et al. | |
| 2005/0227817 | A1 | 10/2005 | Anderson et al. | |
| 2006/0019804 | A1 | 1/2006 | Young | |
| 2006/0035754 | A1 | 2/2006 | Giannelli et al. | |
| 2006/0035755 | A1 | 2/2006 | Dalebout et al. | |
| 2006/0040794 | A1 | 2/2006 | Giannelli et al. | |
| 2006/0166791 | A1 | 7/2006 | Liao et al. | |
| 2006/0217236 | A1 | 9/2006 | Watterson et al. | |
| 2006/0234838 | A1 | 10/2006 | Dalebout et al. | |
| 2006/0247103 | A1 | 11/2006 | Stearns et al. | |
| 2006/0287161 | A1 | 12/2006 | Dalebout et al. | |
| 2007/0060449 | A1 | 3/2007 | Lo | |
| 2007/0060450 | A1 | 3/2007 | Lo | |
| 2007/0117683 | A1 | 5/2007 | Ercanbrack et al. | |
| 2007/0123393 | A1 | 5/2007 | Giannelli et al. | |
| 2007/0123394 | A1 | 5/2007 | Ercanbrack et al. | |
| 2007/0129217 | A1 | 6/2007 | Giannelli et al. | |
| 2007/0129218 | A1 | 6/2007 | Dalebout et al. | |
| 2007/0162823 | A1 | 7/2007 | Dalebout et al. | |
| 2007/0179023 | A1 | 8/2007 | Dyer | |
| 2007/0202995 | A1 | 8/2007 | Roman et al. | |
| 2007/0202999 | A1 | 8/2007 | Giannelli et al. | |
| 2008/0032869 | A1 | 2/2008 | Pacheco et al. | |
| 2008/0051260 | A1 | 2/2008 | Simonson et al. | |
| 2008/0153674 | A9 | 6/2008 | Dalebout et al. | |
| 2008/0167163 | A9 | 7/2008 | Dalebout et al. | |

FOREIGN PATENT DOCUMENTS

| | | |
|---|---|---|
| FR | 498150 | 6/1916 |
| WO | WO95/00209 | 1/1995 |
| WO | WO96/08292 | 3/1996 |

OTHER PUBLICATIONS

CYBEX Cross-Training, "CYBEXceptional," including pages relating to Nova 7 award, Cybex Arc Trainer Nova 7 2004 & 2005 "Best Product of the Year," and "Total Body Arc Trainer The Evolution of Fitness Continues," printed Jun. 14, 2006 (4 pages).

www.cybexintl.com/Products, "Total Body Arc Trainer," printed Jun. 14, 2006 (1 page).

www.cybexintl.com/Products, Arc Trainer, printed Jun. 14, 2006 (1 page).

www.cybexinternational.com, "Total Body Arc Trainer" and "Total Body Arc Trainer" Product #630A, available on information and belief at least as early as Apr. 4, 2007 (2 total pages).

www.cybexinternational.com, "Self Powered Total Body Arc," printed Apr. 4, 2007 (1 page).

www.cybexinternational.com, "425A Arc Trainer," printed Apr. 4, 2007 (1 page).

www.cybexinternational.com, "Home Arc Trainer," printed Apr. 4, 2007 (1 page).

www.nautilus.com, Nautilus® EV718 Pro Series Elliptical, printed Jun. 21, 2006 (2 pages).

"Arc Trainer Specifications," copyright 2005 (1 page).

Sports Authority Newspaper Advertisement, "All Ellipticals and Bikes on Sale," Deseret Morning News, Dec. 6, 2006, one page.

Operations Manual, Q35/Q35e/Pro35, Octane Fitness, 48 pages, copyright 2004.

Operations Manual, Q35, Octane Fitness, 28 pages, copyright 2006.

Assembly Manual, Q35, Octane Fitness, 12 pages, copyright 2006.

Brochure: "EFX 5.37 Elliptical Fitness Cross Trainer," 2 pages, copyright 2007.

Brochure: "EFX 5.17i Elliptical Fitness Cross Trainer," 2 pages, copyright 2006.

www.precor.com, Internet pages relating to EFX Elliptical Fitness Cross Trainer, printed Jan. 3, 2008, 5 pages.

Picture of Summit Trainer Exercise Device, which was available on information and belief at least as early as Jul. 2006, 1 page.

www.us.commerciallifefitness.com, "Summit Trainers," printed Oct. 17, 2006 (3 pages).

Internet archive for www.us.commercial.lifefitness.com, at http://web.archive.org/web/20061016230321/us.commercial.lifefitness.com/, "Summit Trainers," available on information and belief at least as early as Oct. 16, 2006 (3 pages).

"95Le Summit Trainer" and "95Le Summit Trainer Specifications," copyright 2006 (2 pages).

www.uk.corporate.lifefitness.com, "Life Fitness Joins as Associate Sponsor of the 2006 LaSalle Bank Chicago Marathon," printed on Jan. 4, 2008 (2 pages).

Brochure: "Summit Trainers, The latest innovation in cardiovascular exercise," 3 pages available on information and belief at least as early as Jul. 17, 2007 (includes brochure pp. 38-41, 66).
Brochure: "Reach Your Summit," 7 pages, available on information and belief at least as early as Nov. 1, 2006.
Operations Manual, 95Le Summit Trainer, LifeFitness, 53 pages, copyright 2006.
Operations Manual, 95Li Summit Trainer, LifeFitness, 39 pages, copyright 2006.
Assembly Instructions, 95Li Summit Trainer, LifeFitness, 10 pages, available on information and belief at least as early as Dec. 18, 2006.
LifeFitness, "Biomechanical Research Presents Benefits of New Summit Trainer," copyright 2006 (2 pages).
Vision Fitness-About Our Ellipticals, www.visionfitness.com, printed Sep. 13, 2005.
Photographs of Octane Fitness Exercise Device, available on information and belief at least as early as Sep. 2006, 8 photographs (3 pages).
Horizon Series E30 E20, printed on Jul. 27, 2004 from www.horizonfitness .com/horizon-series/ellipticals/e20.php, (1 page).
Horizon Elliptical Specs, printed on Jul. 27, 2004 from www.horizonfitness.com/horizon-series/ellipticals/elliptical-spec.php, (1 page).
User's Manual, NordicTrack CX 998, Model No. 70950, 28 pages, available on information and belief at least as early as Jan. 29, 2005.
User's Manual, NordicTrack EX 1000 Commercial Pro, Model No. NTEL 4255.1, 28 pages, available on information and belief at least as early as May 24, 2006..
User's Manual, Pro-Form XP 520 Razor Elliptical Exerciser, Model No. 831.23744.0, 28 pages, available on information and belief at least as early as Jun. 19, 2007..
Operations Manual, Q47/Q47e/Q47ce Exercise Device, Octane Fitness, 52 pages, copyright 2007.
Quality Control Checklist, Q47 Deluxe Console, Document No. 102389-001 Rev. A, dated Jun. 13, 2007, 1 page.
Quality Control Checklist, Q47 Base, Document No. 102387-001 Rev. A, dated Jun. 13, 2007, 1 page.
Octane Fitness table listing Q47 Specs, Q37 Specs, and Q35 Specs, available on information and belief at least as early as Sep. 2007, 1 page.
Internet archive for www.octanefitness.com, "Octane Fitness: Front Page," available on information and belief at least as early as Jun. 29, 2005 (1 page).
Internet archive for www.octanefitness.com, "Home Products," available on information and belief at least as early as Jun. 12, 2006 (1 page).
Internet archive for www.octanefitness.com, "Press Room," available on information and belief at least as early as Dec. 20, 2005 (1 page).
Internet archive for www.octanefitness.com, "Research," available on information and belief at least as early as Sep. 8, 2005 (1 page).
Internet archive for www.octanefitness.com, "Service," and "Club Products," available on information and belief at least as early as Apr. 9, 2005 (2 pages).
Internet archive for www.octanefitness.com, Testimonial pages, available on information and belief at least as early as Oct. 23, 2005 (11 pages).
Internet archive for www.octanefitness.com, pages entitled "Feel" (4 pages) and "Electronics" (2 pages), available on information and belief at least as early as Jan. 3, 2006 (6 total pages).
Internet archive for www.octanefitness.com, entitled "Feel," available on information and belief at least as early as Dec. 22, 2005 (1 page).
Internet archive for www.octanefitness.com, pages entitled "Why are elliptical trainers so popular," "Effectiveness of Elliptical Trainerss," Impact your life, not your body! "Total Body Workout," "Minimal Maintenance," "Small Footprint," "Retailers," available on information and belief at least as early as Dec. 31, 2005 (7 pages).
Internet archive for www.octanefitness.com, pages entitled, "Elliptical Cross Training," (3 pages), "Body-Mapping Ergonomics," (2 pages) and "Elliptical Trainers and Pregnancy," (3 pages) available on information and belief at least as early as Dec. 26, 2005 (8 total pages).
Internet archive for www.octanefitness.com, pages entitled, "White Papers," "Company History," "Electronics," "Programs Q45/Q45e," "Programs Pro35," "Programs Pro350/Pro350XL," "X-Mode+ Pro35/Pro350/Pro350XL," "X-Mode Q35 and Q45," "X-Mode+ Q35e/Q45e," "X-Mode+ Pro35/Pro350/Pro350XL," "SmartStride Q45/Q45e," "SmartStride Q45/Q45e," "Elliptical Shopping Guide," "Specs," (2 pages), "Consumer Guide Best Buy," "Octane Q45e" "Consumer Guide Best Buy," "Octane Q35e," "Heart Rate Training," (3 pages), available on information and belief at least as early as Mar. 14, 2006 (20 total pages).
Office Action in U.S. Appl. No. 11/832,634 dated Aug. 14, 2008.
Office Action in U.S. Appl. No. 11/832,634 dated Dec. 9, 2008.
Office Action dated Jun. 9, 2009 from U.S. Appl. No. 11/832,634 (14 pages).
International Search Report mailed Jul. 16, 2008 from PCT Application No. PCT/US2007/075108 (3 pages).
International Search Report mailed Apr. 4, 2008 from PCT Application No. PCT/US2007/075112 (2 pages).
Office Action dated Oct. 29, 2009 for U.S. Appl. No. 11/832,634 (11 pages).

* cited by examiner

VARIABLE STRIDE EXERCISE DEVICE WITH RAMP

RELATED APPLICATIONS

The present application claims priority to and the benefit of U.S. Provisional Patent Application Ser. No. 60/834,928, filed Aug. 2, 2006 and entitled "EXERCISE DEVICE WITH PIVOTING ASSEMBLY, and U.S. Provisional Patent Application Ser. No. 60/908,915, filed Mar. 29, 2007 and entitled "VARIABLE STRIDE EXERCISE DEVICE WITH RAMP" the disclosures each of which are incorporated herein by reference in their entirety. United States Utility patent application Ser. No. 11/832,634, entitled "EXERCISE DEVICE WITH PIVOTING ASSEMBLY" with inventors Roy Simonson, William Dalebout, and Jaremy Butler filed Aug. 1, 2007, the same day as the filing date of the present application, is also incorporated herein, in its entirety by reference.

BACKGROUND OF THE INVENTION

1. The Field of the Invention

The present invention relates to exercise equipment. More particularly, the invention relates to a non-impact exercise device with a reciprocating motion.

2. The Relevant Technology

In light of the intense modern desire to increase aerobic activity, exercises including jogging and walking have become very popular. Medical science has demonstrated the improved strength, health, and enjoyment of life which results from physical activity.

Despite the modern desire to improve health and increase cardiovascular efficiency, modern lifestyles often fail to readily accommodate accessible running areas. In addition, weather and other environmental factors may cause individuals to remain indoors as opposed to engaging in outdoor physical activity.

Moreover, experience in treating exercise related injuries has demonstrated that a variety of negative effects accompany normal jogging. Exercise-related knee damage, for example, often results in surgery or physical therapy. Joints are often strained when joggers run on uneven surfaces or change direction. Other examples of common injuries resulting from jogging, particularly on uneven terrain, include foot sores, pulled muscles, strained tendons, strained ligaments, and back injuries.

As the population ages, there is a considerable need for exercise devices that have no impact on the joints. Hip and knee replacements are very expensive to the individual and to society in general. To the extent that joint replacements may be avoided, it is useful to have exercise devices that allow for an extreme workout without the potential strain imparted onto the load-bearing joints of the user.

There is a long standing need in the general area of exercise devices for a non-impact device with a reciprocating motion that approximates a variety of real world exercise movements. There are a variety of non-impact exercise devices that have a cyclical motion, such as elliptical trainers. Typical exercise devices often have a fixed stride length for exercise motion. With the same repetitive and unchangeable movement, the user is relegated to using the same sets of muscles to the detriment of other muscles. There is therefore a need for an exercise device that overcomes the disadvantages of typical exercise machines.

BRIEF SUMMARY OF THE PREFERRED EMBODIMENTS

The present invention is directed to a non-impact, striding exercise device capable of a variety of exercise motions and having a variable stride length. In one embodiment, the device includes a framework, at least one ramp assembly, a pair of foot support assemblies, a foot location control assembly coupled to the foot support assemblies so as to provide resistance against the user's movements, and means for adjusting a maximum stride length of the foot support assemblies. A user mounts the exercise device by stepping onto the foot platforms and holding onto the handles. The user is able to engage in a reciprocating, striding motion by putting force into the foot platforms and/or the handles. Movement of either the handles or the foot platforms causes the foot platforms to move along an associated ramp of the ramp assembly. The shape of the ramp(s) dictate the path of the exercise movement that the user experiences.

One advantage of the present invention is that the user is able to choose the length of their stride, which may be 30 inches or more. The present exercise device is designed so that it is easy for the user to enter into a linearly reciprocating motion without having to overcome the substantial inertia commonly experienced while reversing direction while using other reciprocating exercise devices, such as elliptical exercise devices. Elliptical exercise devices often use a crank and a heavy flywheel that combine to fix the path of the user's motion into a cycle that impels itself and makes it very difficult for the user to reverse direction. The present exercise device is designed such that the direction of the foot platform is easily reversed, slowed, or sped up with a minimal input of force from the user. This enables the user of the exercise device to be able to easily change their stride length from the infinitesimal all the way up to the user's maximum stride. The ability of the user of the exercise device to determine their own stride length is not only beneficial to users of different heights, but also allows the same user the flexibility to vary their workout on the exercise device by adjusting the length and frequency of the striding motion.

In addition, the present invention provides a non-impact exercise device that allows a user to simulate the exercise movements of elliptical or stair stepper motions, in a minimal amount of space. This combines a reduction in injury potential with a total body workout capability in a single exercise device. The upper portion of the ramp assembly is relatively vertical, corresponding to the movements of a stair stepper exercise, while the lower portion of the ramp assembly is relatively horizontal, corresponding more to the movements of an elliptical exercise. By adjusting the location of the foot supports, a user is easily able to work primarily at the upper end of the ramp assembly, at the lower end of the ramp assembly, or anywhere in between. In addition, the user is able to select their own desired stride length during an exercise routine, and change it accordingly at will without having to stop and adjust a mechanism.

The present exercise device may include a foot location control assembly to aid the user in selecting and maintaining a stride within a desired portion of the ramp assembly. The foot location control assembly is selectively adjustable by the user to effectively alter the upper and/or lower terminus of each foot support assembly. As mentioned, the foot location control assembly may be positioned so as to set upper termini of the foot support assemblies so that user's stride motion is within a substantially horizontal portion of the ramp assembly. Alternatively, the foot location control assembly may be positioned so as to force the user to work within a substantially vertical portion of the ramp assembly, or anywhere in between.

The present exercise device is compact. In one preferred embodiment, the connection between the foot support assemblies, the handles, and the resistance assemblies are made via a flexible cable linkage, such that there are no rigid swinging arms or elbows. As such, the connecting cables are able to be contained within a substantially more compact exercise unit versus a swinging arm configuration that relies on connecting the upper and lower parts of the exercise machine via link arms and rods. Along with the overall simplicity and compactness of such a design, this feature helps to create an exercise device that is safer by eliminating the rigid swinging parts that have substantial momentum.

Another advantage of the present invention is that the user has unobstructed access to the exercise device. Certain exercise devices that have a reciprocal motion, such as purely elliptical devices, are enclosed by a bulky cage that surrounds the moving parts of the exercise device. Other devices having swinging members that arc out a large path through the operating space. Often times, such devices are only accessible through an opening in a cage-like frame assembly that surrounds the user interface of the elliptical exercise device. An advantage of the present exercise device is the ease of entry and simplicity of the design which allows a smaller footprint without having a relatively large cage-like frame assembly enclosing the moving parts of the exercise device. The lack of such a frame assembly allows the user of the exercise device to access the device from both the first and second sides as well as through the rear of the device.

These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by references to specific embodiments thereof, which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

I. Introduction

Figure 9:
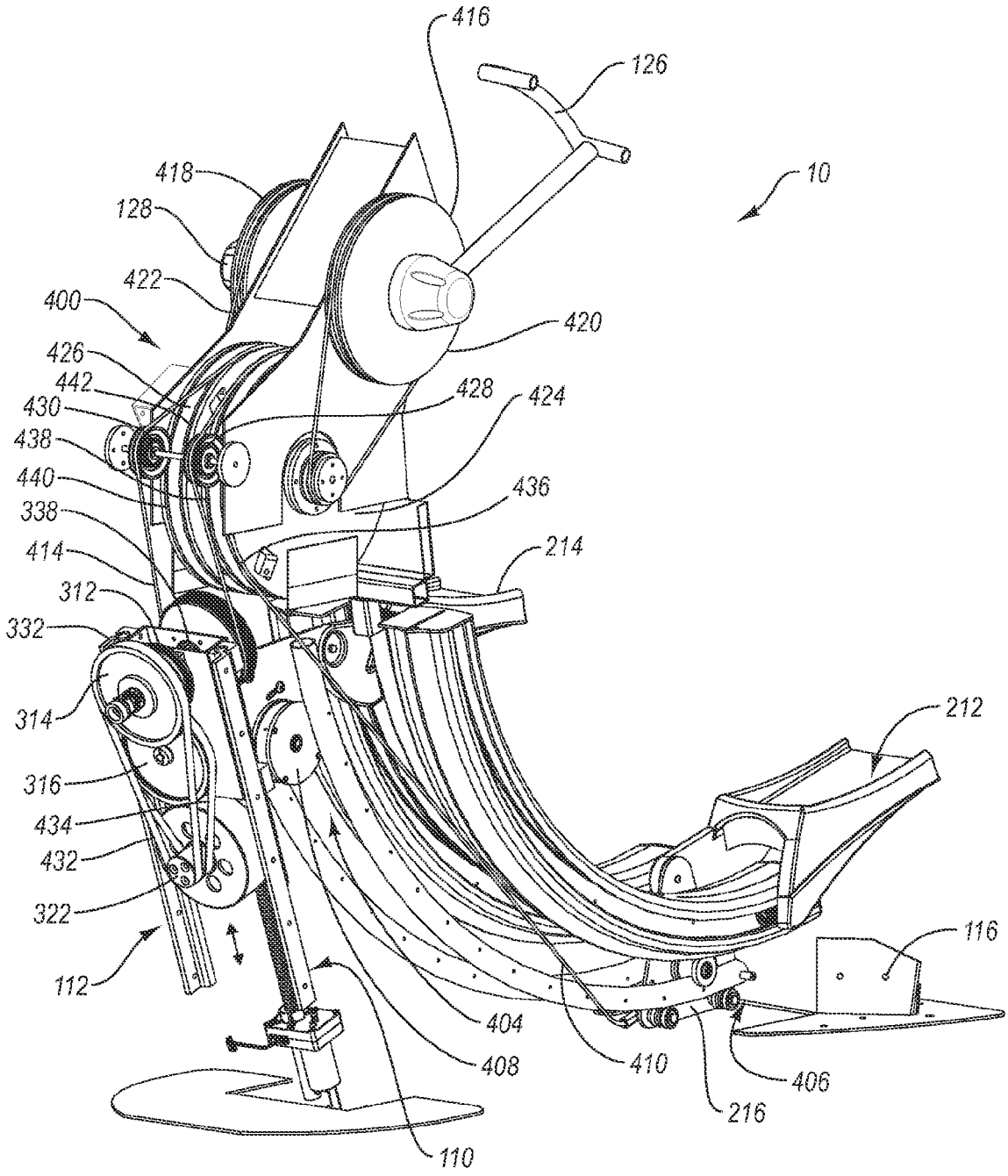
FIG. 9 is a perspective view of an embodiment of the exercise device of FIG. 1; depicting the linkage assembly.

The exercise device of the present invention is a non-impact, striding exercise device that enables a variety of exercise movements. An exercise device 10 comprises (i) a framework 100, (ii) a pair of spaced apart ramp assemblies 200, 202, (iii) a pair of spaced apart foot platform assemblies 212, 214, (iv) a foot location control assembly 300, (v) and a linkage assembly 400 (FIGS. 9-10B).

A user mounts exercise device 10 by stepping on top of first foot support assembly 212 and second foot support assembly 214. Foot platform assemblies 212, 214 roll upon a pair of spaced apart ramp assemblies 200, 202. The path that the user's feet travel is defined by first and second spaced apart foot platform assemblies 212, 214 as they roll along respective underlying first and second ramp assemblies 212, 214. As will be discussed later, through changing the position of foot location control assembly 300, the user of exercise device 10 may vary the exercise motion from a substantially elliptical motion, to a substantially stair-stepping motion.

The user moves spaced apart foot platform assemblies 212, 214 in a reciprocating manner in a variety of exercise planes defined by the length and shape of spaced apart ramp assemblies 200, 202. A user's exercise stride length may be all the way from very small movements (e.g., 0 to about 3 inches) to very large movements (e.g., more than 30 inches, even as high as 44 inches, for example, or more), and any increment therebetween. As will be discussed later, the design of ramp assemblies 200, 202 enables foot platform assemblies 212, 214 to remain at an ergonomically favored angle throughout the user defined exercise stride.

II. Framework

Framework 100 supports ramp assemblies 200, 202, and foot location control assembly 300 all within a relatively narrow footprint. This allows easy access to exercise device 10 rather than having a "cage" surrounding the device that makes access inconvenient.

Turning now to the drawings, FIGS. 1-10B refer to embodiment 10 of the exercise device that has a reciprocally dependent movement of spaced apart handlebars 126, 128 and spaced apart foot platform assemblies 212, 214. Spaced apart foot platform assemblies 212, 214 move upon spaced apart ramp assemblies 200, 202. A user may define their exercise quality through foot location control assembly 300, which is coupled with the movement of spaced apart foot assemblies 212, 214 and spaced apart handlebars 126, 128, through flexible linkage assembly 400.

Figure 1:
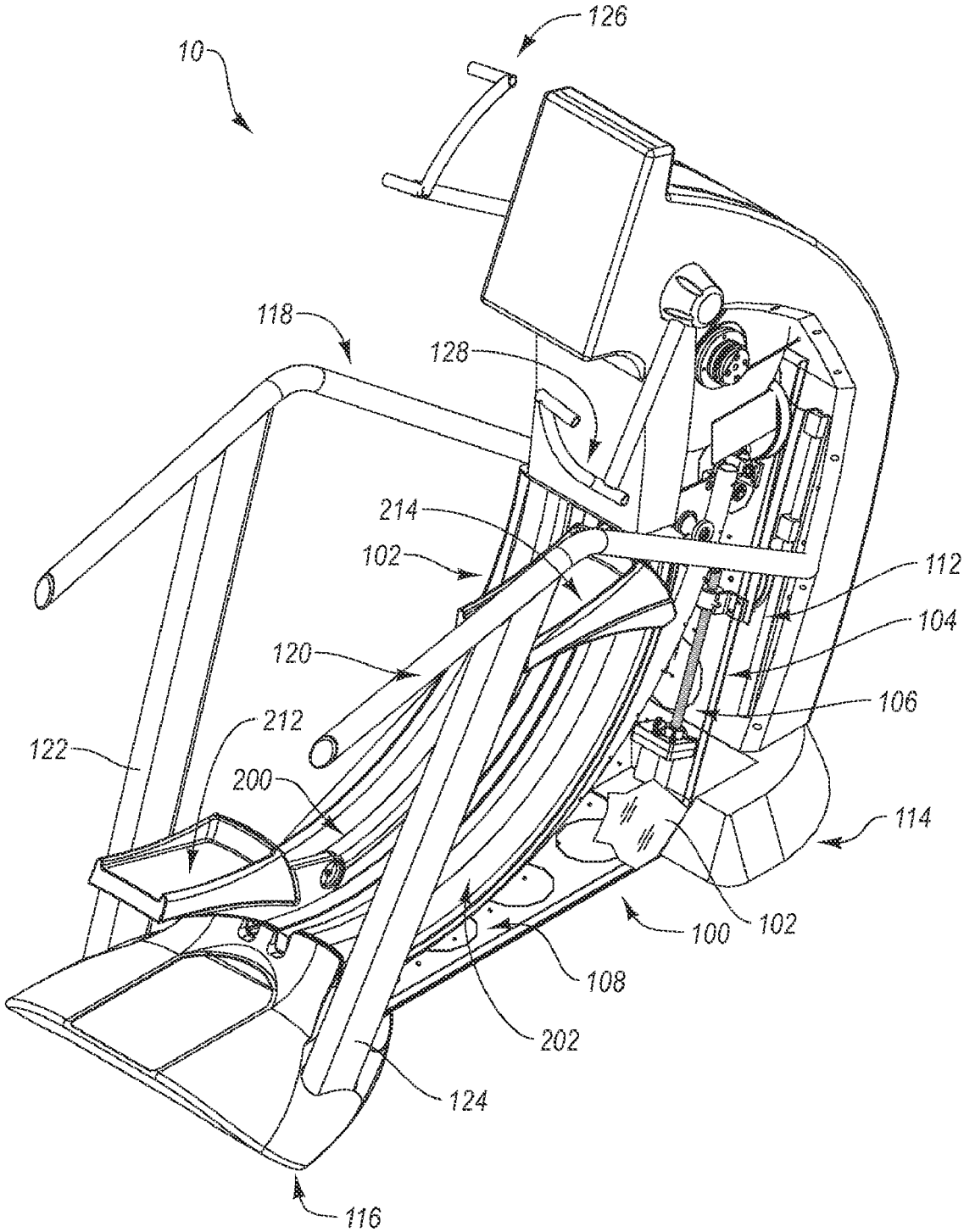
FIG. 1 is a side perspective view of an embodiment of the present invention depicting the foot platforms in a first configuration.

FIG. 1 is a perspective view of exercise device 10. Framework 100 comprises a first side panel 102 (partially cut away), a second side panel 104 (cut away from FIG. 1 for clarity, shown later in FIG. 5), an upright gusset 106, a bottom gusset 108, a front stabilizer member 114, a rear stabilizer member 116, a first hand rest 118, a second hand rest 120, a first rear support 122 for supporting hand rest 118, and a second rear support 124 for supporting hand rest 120. First and second ramp assemblies 200, 202 are mounted at a front end to upright gusset 106 and at a rear end to rear stabilizer member 116.

First side panel 102 and second side panel 104 are substantially vertical and parallel to one another. First side panel 102 is connected at or near one end to upright gusset 106 and at or near a bottom end to bottom gusset 108. Second side panel 104 is attached to opposite sides of upright gusset 106 and bottom gusset 108. Upright gusset 106 is connected to bottom gusset 108 in an essentially perpendicular configuration. First guide rail 110 and second guide rail 112 are bolted or otherwise fastened to the interior of first side panel 102 and second side panel 104, respectively. As will be discussed later, first guide rail 110 and second guide rail 112 run in a substantially vertical direction, may be essentially parallel to upright gusset 106 and act to guide the movement of foot location control assembly 300.

Front stabilizer member 114 is perpendicularly fixed to the front lower portions of first and second side panels 102, 104. Rear stabilizer member 116 is perpendicularly fixed to the rear lower portions of first and second side panels 102, 104. Together, front and rear stabilizer members 114, 116, rest upon a support surface such as a floor and help to stabilize exercise device 10.

To help stabilize the user of exercise device 10, framework 100 may contain first and second spaced apart hand rests 118, 120. The front end of first and second spaced apart hand rests 118, 120 may respectively be connected to first and second spaced apart side panels 102, 104. First and second spaced apart hand rests 118, 120 are further supported by first and second spaced apart rear supports 122, 124. A user of exercise device 10 may use hand rests 118, 120, for example when they become fatigued from using exercise device 10 or simply as an alternative to handle bars 126, 128. In another embodiment, a pair of additional stationary handle bars 126*a* and 128*a* may also be provided near and at approximately the same height as handle bars 126, 128 (e.g. see FIG. 11A).

Figure 2:
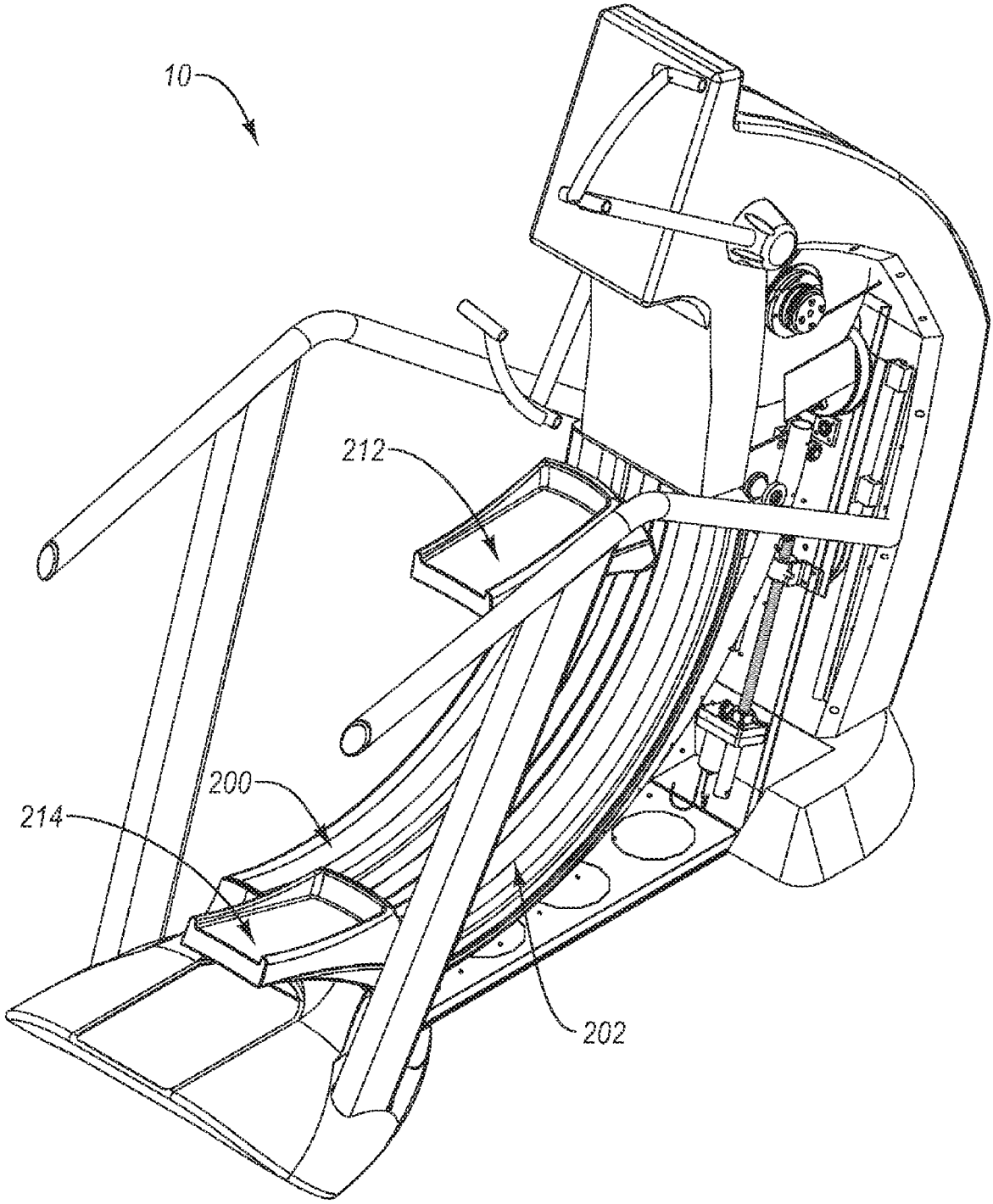
FIG. 2 is another perspective view of the exercise device of FIG. 1 depicting the foot platforms in a second configuration.

FIG. 2 depicts a perspective view of exercise device 10 with foot platform assemblies 212, 214 in an orientation opposite that depicted in FIG. 1.

Figure 3:
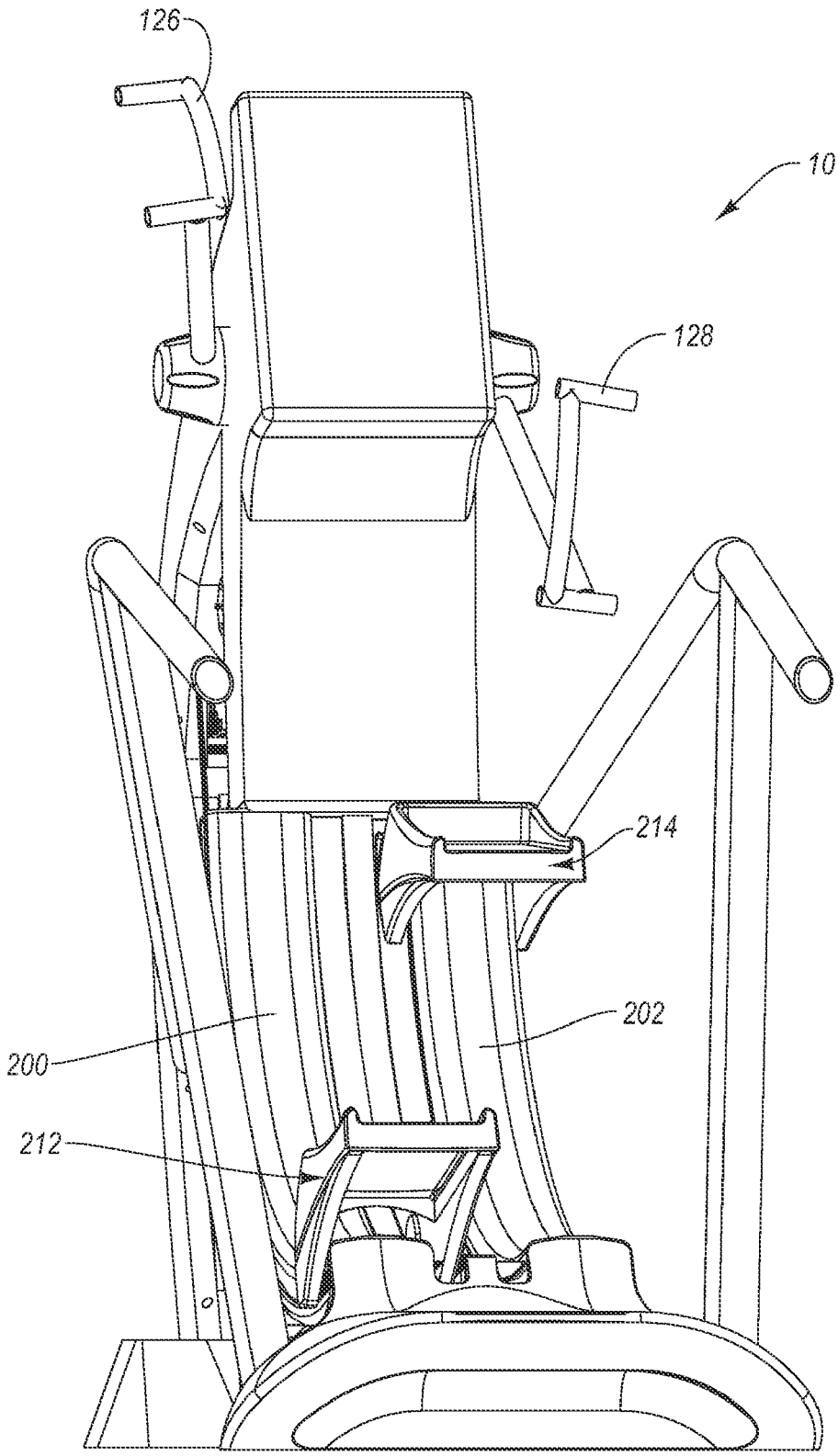
FIG. 3 is a rear view of the exercise device of FIG. 1.

FIG. 3 depicts a rear perspective view of exercise device 10 showing the easy accessibility that a user has to exercise device 10, as well as the overall narrow profile of exercise device 10.

Figure 4:
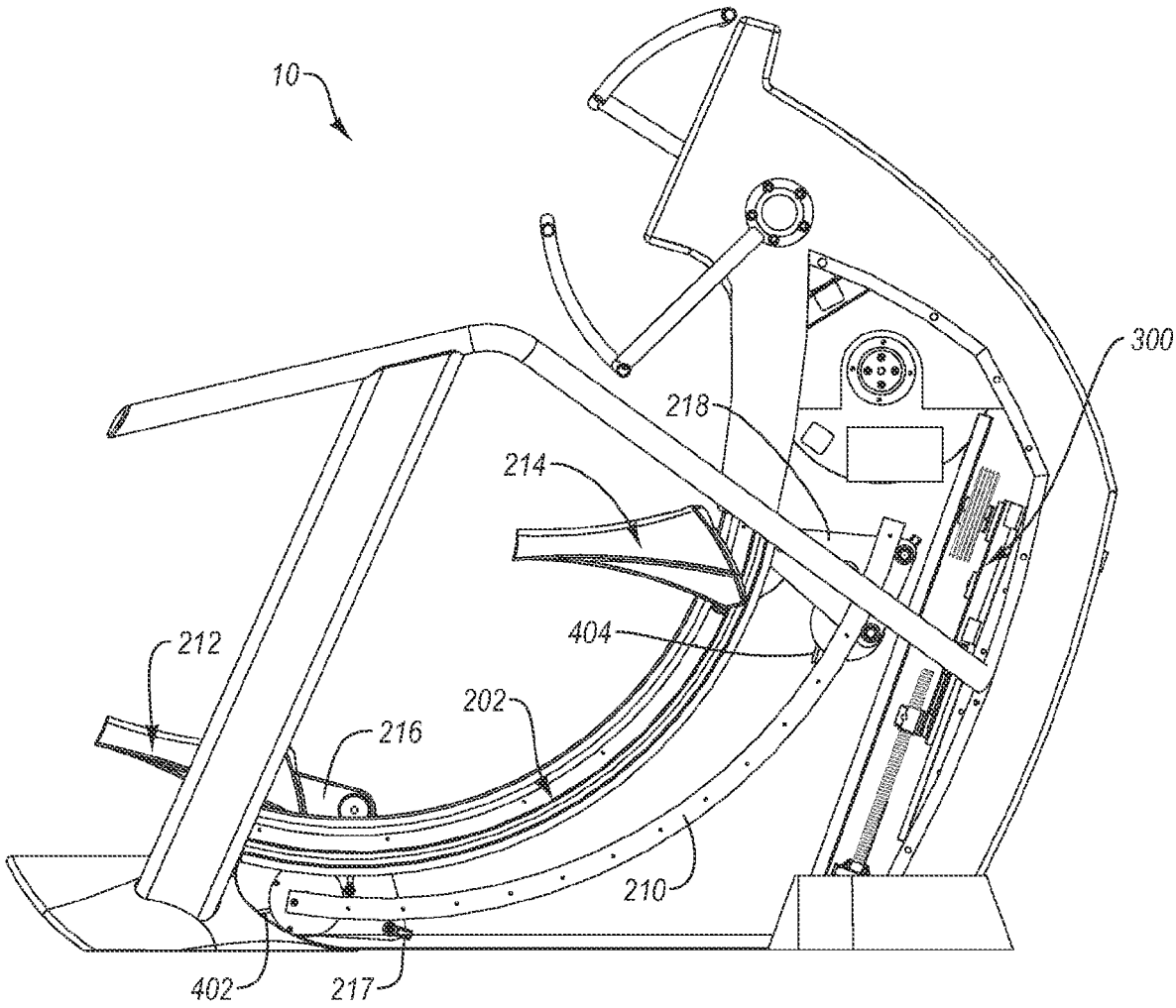
FIG. 4 is a side view of the exercise device of FIG. 1.

FIG. 4 depicts a side perspective view of exercise device 10 showing the overall configuration of framework 100, ramp assemblies 200, 202, foot platform assemblies 212, 214, and foot location control assembly 300. As will be discussed later, FIG. 4 also depicts a front cable attachment 217 to linkage assembly 400.

III. Ramp Assembly

Figure 5:
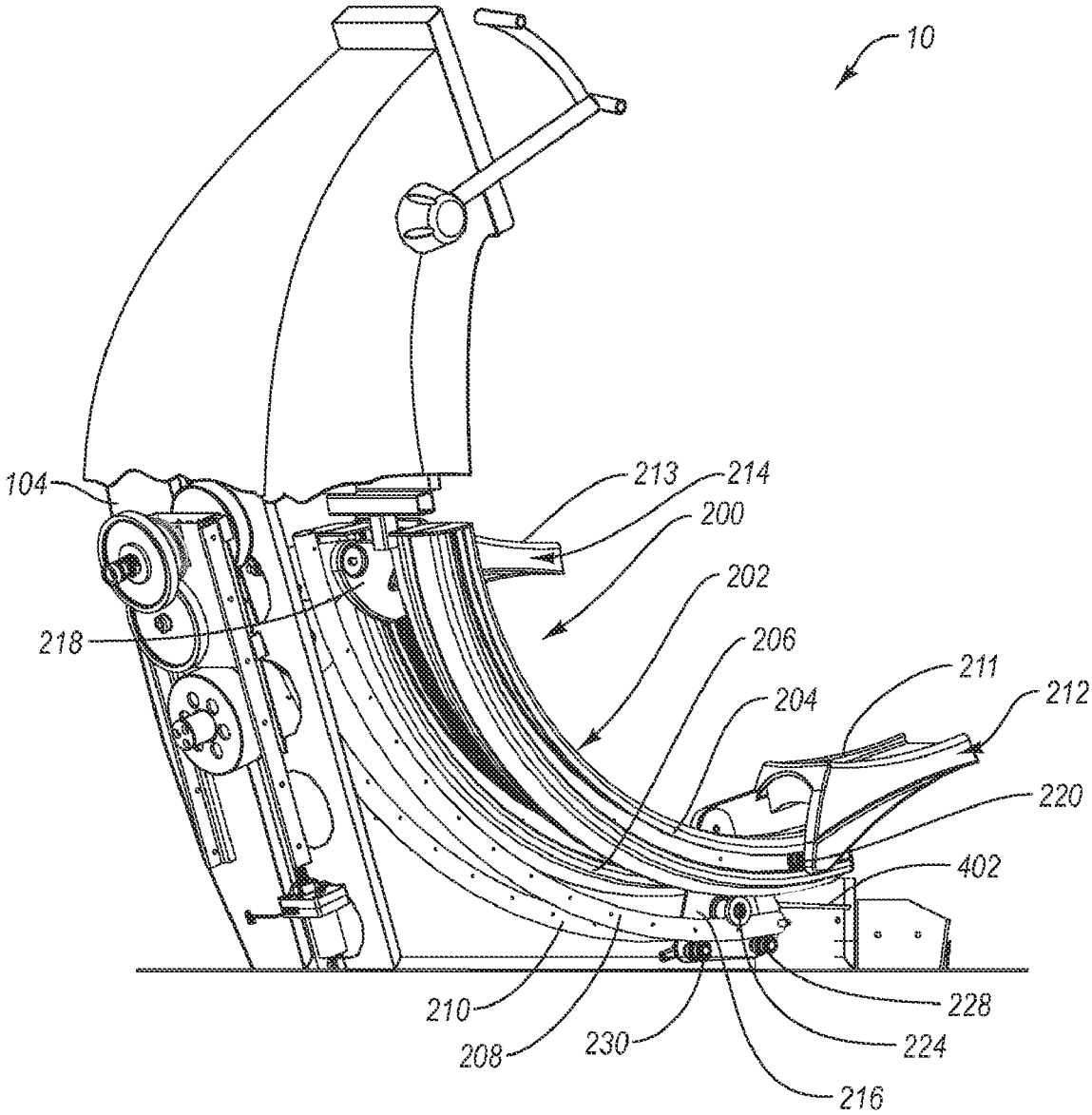
FIG. 5 is another side view of the exercise device of FIG. 1.

FIG. 5 depicts exercise device 10 from a side perspective, highlighting spaced apart ramp assemblies 200, 202 and spaced apart foot platform assemblies 212, 214. Each of spaced apart ramp assemblies 200, 202 have an upper ramp 204, 206 as well as a respective lower guide tube member 208, 210. Each upper ramp 204, 206 follow the same arc or curve. Each lower guide member 208, 210 follow the same arc or curve. Each spaced apart ramp assembly 200, 202 is attached to upright gusset 106 at a front end and to rear stabilizer member 116 at a rear end.

Spaced apart foot platform assemblies 212, 214 each include a respective foot platform 211, 213 and respective foot platform brackets 216, 218. Foot platforms 211, 213 are pivotally attached at their respective front ends to the top ends of respective foot platform brackets 216, 218. First and second spaced apart foot platforms 211, 213 may have an overall perpendicular orientation to respective foot platform brackets 216, 218 when the assembly is near the lower portion of the ramp assembly, and a substantially parallel orientation relative to the associated bracket when the assembly is near the upper portion of the ramp assembly, as shown in FIG. 5.

Spaced apart foot platforms 211, 213 rest upon respective upper ramps 204, 206 by respective upper ramp wheels connected to the bottom of each respective foot platform 211, 213. For clarity, only upper ramp wheel 220 of foot support assembly 212 is shown in FIG. 5, although it will be understood that foot support assembly 214 may be an identical or similar mirror image thereof.

Figure 5A:
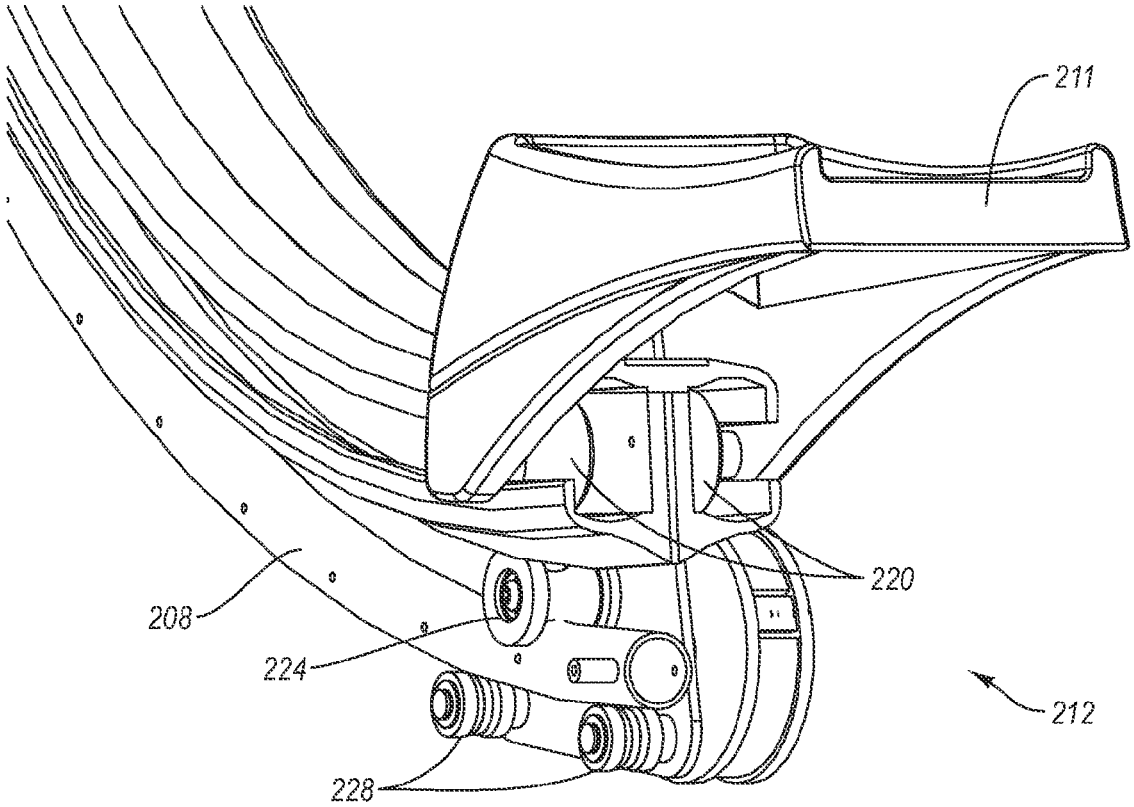
FIGS. 5A, 5B and 5C are close-up views of a foot support assembly of the exercise device of FIG. 1, for clarity, FIG. 5C does not show the spring loaded drum pulley.
Figure 5B:
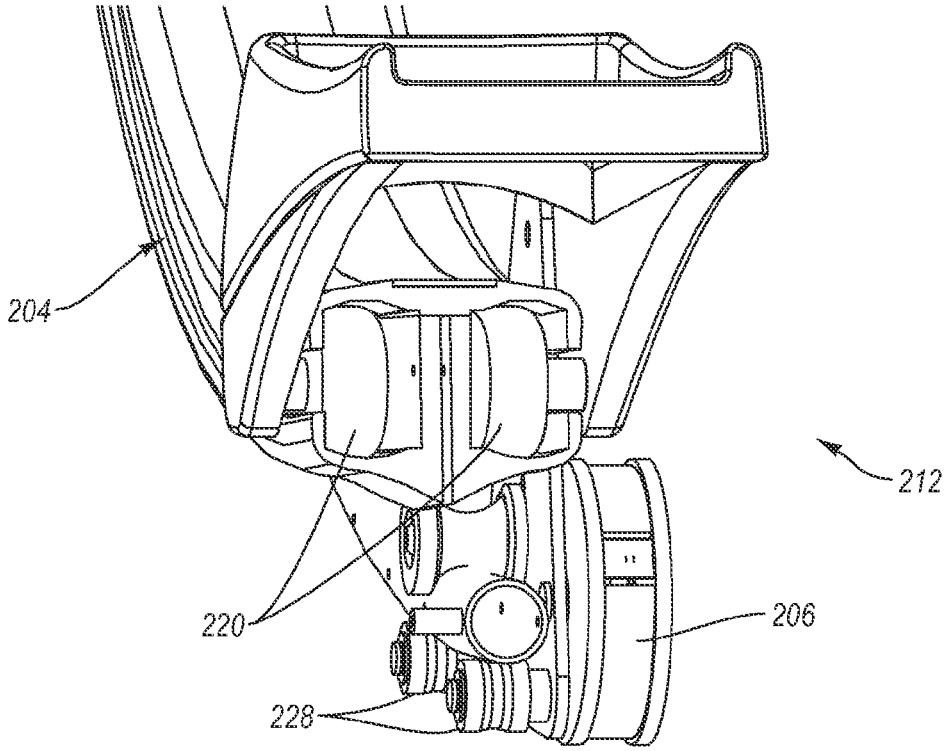
Figure 5C:
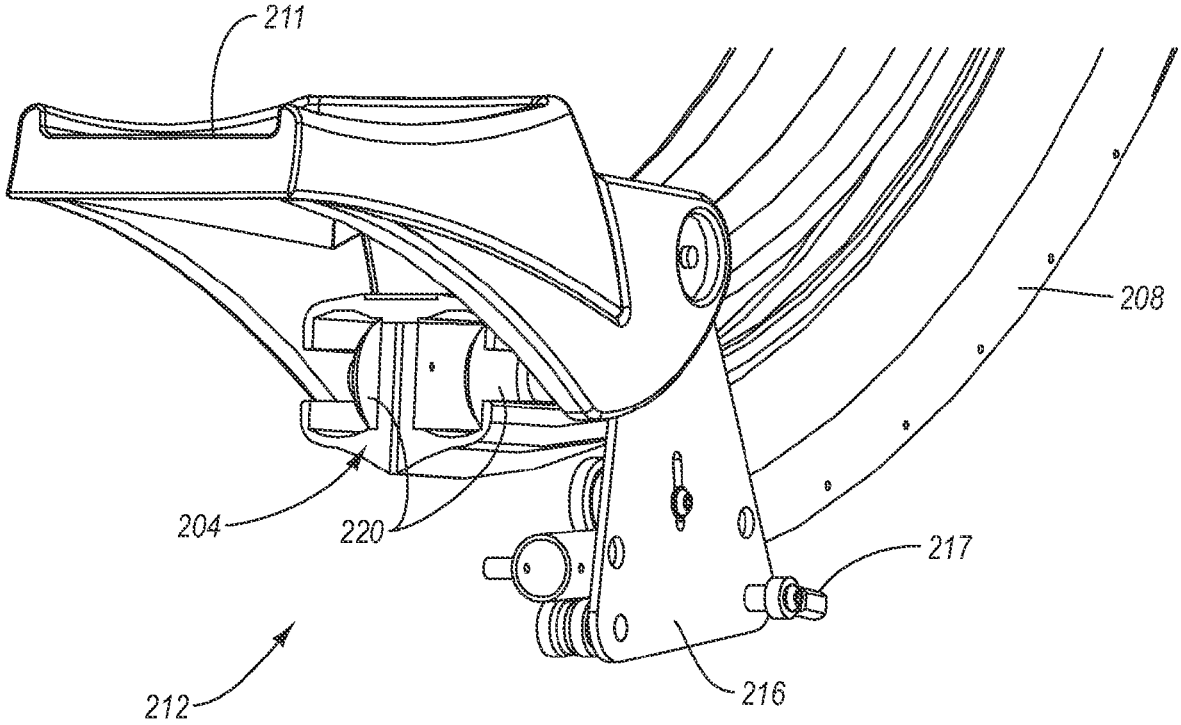

FIGS. 5A, 5B and 5C further depict the foot platform assemblies. Foot platform bracket 216 is coupled to lower guide member 208 by foot platform bracket upper wheel 224, which rolls along a top surface of lower guide member 208. Bracket 216 further includes a pair of lower wheels 228, 230 to securely couple the foot support assembly 212 to lower guide member 208 of ramp assembly 204.

Therefore, spaced apart foot platform brackets 216, 218 are movably fixed to roll along respective spaced apart lower guide members 208, 210 because of the configuration of their respective first and second foot platform bracket upper wheels 224, 226 and respective lower wheels 228, 230 which "sandwich" respective first and second lower guide members 208, 210 between the wheels.

Figure 5D:
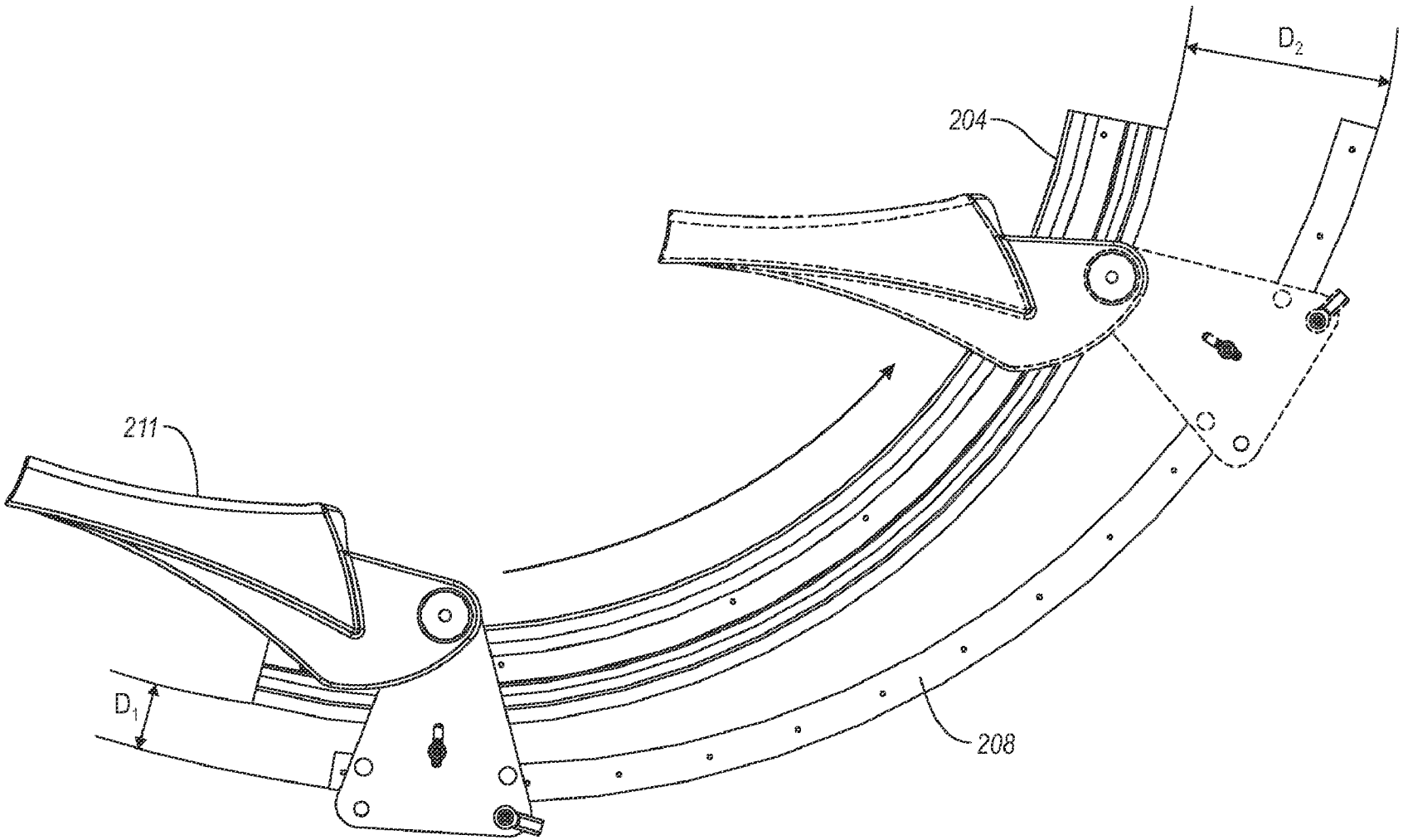
FIG. 5D is a schematic representation of the movement of a foot support assembly upon a ramped surface of the exercise device of FIG. 1.

FIG. 5D depicts a schematic representation of the movement of a foot support assembly along a ramp assembly. In an embodiment of exercise device 10, each first and second lower guide member 208, 210 may advantageously be a different length and a different arc or curve relative to respective upper ramps 204, 206. In one embodiment, upper ramps 204 and 206 form arcs (i.e., representing a portion of a circle) having a first radius, and the lower guide members 208 and 210 forming arcs having a second, different (e.g., larger) arc radius. For example, ramps 204 and 206 may include a curvature radius of about 31 inches, while guide members 208 and 210 include a curvature radius of about 38 inches. These different curvatures help maintain a desired pedal orientation during movement of the foot platform assemblies along the ramps and guide members. Such a configuration results in an exercise device 10, is shown in FIG. 5D where each lower guide member 208, 210 is separated from its respective upper ramp 204, 206 by a larger distance D2 at their respective front ends than the distance D1 of separation at their respective rear ends, as depicted in FIG. 5D. Since foot platforms 211, 213 roll along upper ramps 204, 206 and since foot platform brackets 216, 218 roll along lower guide members 208, 210, the top end of each foot support assembly 212, 214 travels a different path than does the bottom end of each foot support assembly 212, 214. Alternative embodiments may include other types of curves (e.g. an elliptical-like curve representing a portion of an ellipse, an exponential type curve, or other curve).

The different paths that the top and bottom ends of foot platform assemblies 212, 214 travel, coupled with the pivoting attachment of the front of the foot platforms 211, 213 to the top of foot platform brackets 216, 218, can impart an articulation upon foot platforms 211, 213 throughout the travel of the foot platform assemblies 212, 214 as they travel along ramp assemblies 200, 202. In one embodiment, this articulation, as shown in FIG. 5D, for example, results from the movement of the bracket upwardly with respect to the foot platform 211, and causes foot platform 211 to pivot slightly as it moves from a lower position to an upper position, but to still remain substantially parallel to a support surface. The amount of movement of foot platform 211 can be readily adjusted as desired by adjusting the curvature of upper ramp 204 and/or lower guide member 208.

In another embodiment of exercise device 10, which is not depicted, there may be a single, continuous upper ramp instead of first and second spaced apart upper ramps 204, 206. In another embodiment of exercise device 10, spaced apart first and second foot platforms 211, 213 may each rest upon a single upper ramp wheel instead of each platform resting on a pair of upper ramp wheels 220 (i.e., one on either side of upper ramp 204).

As mentioned, ramp assemblies 200, 202 may be of any arced or curved shape such that the path foot platform assemblies 212, 214 travel along respective ramp assemblies 200, 202 may be a range of curved shapes. The shapes of the curves are dependent upon what kind of movement/workout the device is intended to deliver and/or the user wants. The human body's natural hip, knee and ankle movements may be factored into the design of ramp assemblies 200, 202. The movement of the joints throughout the stride can be engineered to conform to the natural motion of the hips, knees and ankles such that awkward, painful and unnatural angles are avoided.

One configuration provides upper ramps 204 and 206 which comprise a first arc representing a portion of a circle having a first one radius, and the lower guide members 208 and 210 also comprise an arc representing a portion of a circle, but of a larger radius. Such a configuration has been found to provide for a natural body motion relative to the hips, knees, and ankles during exercise. For example, as shown in FIG. 4 and FIG. 5D, such a configuration of ramp assemblies 200 and 202 can result in an articulation of the foot platform (e.g., see foot platform 211) which angles the user's toes upwards near the top portion of the ramp assembly at about 1° to about 5° (e.g., 2°). Similarly, when the foot platform (e.g. see foot platform 213) is near the bottom portion of the ramp assembly, the user's toes can be angled downward at about 5° to about 15° (e.g., 10°). Other articulations of the foot platforms and foot support assemblies are possible simply by altering the configuration of the upper ramps 204, 206 and/or the lower guide members 208, 210, for example by changing the radii of one or both components. Changes in articulation may also be accomplished by altering the configuration of the foot platform brackets 216, 218 which couple the foot support assemblies to the ramp assemblies.

The movement of foot platform assemblies 212, 214 may comprise two strokes, a power stroke and a return stroke. The power stroke is the movement when foot platform assemblies 212, 214 impart energy into braking device 324, depicted in FIGS. 6 and 6A. The return stroke is the opposite movement and may not impart energy into braking device 324. The power stroke correlates to the downward motion of foot platform assemblies 212, 214.

Braking device 324 is also a flywheel, storing angular momentum as the exercise device is being used. Braking device 324 may be used as a brake in order to retard the rotation of the drive pulley assembly. Braking device 324 may be an eddy brake. In an embodiment, braking device 324 is responsible for generating the current necessary to power the display and computer of the exercise device.

Another advantage of the present invention over the prior art is that exercise device 10 has a variable stride length. The overall stride length may be varied from a barely perceptible movement all the way out to the limit of the lengths of ramp assemblies 200, 202. The stride length is measured along the arc length of the ramp. In some embodiments of the exercise device, the user's stride may be at least about 30 inches measured along the arc length of the ramp. In one embodiment, the stride length is at least about 35 inches. In another embodiment the stride length is at least about 40 inches. In yet another embodiment, the stride length is at least about 44 inches. The stride length can be more. The length of the stride is limited by the length of ramp assemblies 200, 202. The stride length can also be limited by the cabling of the resistance assembly. The advantages of having a large and variable range of motion will be appreciated by any user of exercise devices. Users of different heights can determine what the comfortable range of motion is for them. A user is not limited to a "one size fits all" reciprocating device where the path of the movement is fixed. The infinitely variable stride length allows a user of any height to get a complete range of motion while using exercise device 10. When the foot location control assembly 300 is near its middle position, the user may use the entire length of ramp assemblies 200, 202 create a full range of motion in order to increase the difficulty of the striding motion, and for a more complete stretch of the tendons, ligaments and muscles of the legs.

If the user wants to work at a higher frequency with a smaller stride length, the user can change the stride motion by changing the force put in through foot platform assemblies 212, 214 and/or handles 126, 128.

Elliptical exercise devices commonly have a crank that fixes the motion as well as a flywheel that makes changing the direction of the motion difficult. The user of an elliptical device is typically limited to movement within the elliptical cycle of motion prescribed by the crank. The user of a typical elliptical device must overcome the substantial inertia of the flywheel in order to change direction. Because exercise device 10 of the present invention has linkage system 400 and foot location control assembly 300 coupled to movement of foot platform assemblies 212, 214 along ramp assemblies 200, 202, the user is in control of the quality and type of exercise motion they want to experience. Unlike a devoted stair stepper or elliptical device, the stride length of the present exercise device is not predefined nor is the quality of the exercise movement unchangeable.

An additional benefit of the present invention is that it is substantially more compact than other exercise devices on the market. FIG. 4 depicts the long potential stride length relative to the overall longitudinal footprint of exercise device 10. Ramp assembly length, and therefore the possible stride length, may be as much as around 50% of the overall length of exercise device 10, for example. The amount of movement that the user experiences is very large compared to the small lengthwise footprint of the exercise device.

FIG. 2 also depicts the narrow horizontal footprint of the exercise device. Compared to other exercise devices that have a bulky, cage-like enclosure around their moving parts, the present exercise device is narrow. Since framework 100 is substantially the same width as the moving portions of exercise device 10, the overall footprint of exercise device 10 is substantially smaller than other devices on the market. For example, in typical elliptical exercise devices, the moving parts of the exercise device are within a large cage-like frame assembly that prevents the device from falling over.

A further advantage of the current exercise device is that the size, and hence the footprint on the support surface, is substantially contained within the moving parts of the device, and vice versa. This decreased footprint offers substantial benefits to both the home user and the commercial user. The present exercise device takes up less space in the home of the user as well as increasing the amount of floor space available in a commercial gym that offers the present exercise device instead of other devices.

The movement of foot platform assemblies 212, 214 and handlebars 126, 128 can duplicate a movement that is essentially the natural gait of a walking person. While the user of the present exercise device is standing upon foot platform assemblies 212, 214, they may put exercise device 10 into motion by imparting a force through handlebars 126, 128 and/or foot platform assemblies 212, 214. For example, when a user stands upon foot platform assemblies 212, 214 and grabs handlebars 126, 128 and moves their second foot in a forward direction, the first foot will move rearward, the user's first hand will move in a forward direction, and the user's second hand will move in a rearward direction. In this way, the movement of foot platform assemblies 212, 214 and handlebars 126, 128 may be reciprocally related to one another.

In some exercise devices such as a typical elliptical exercise device, there is a significant amount of momentum associated with the movement of the crank and foot supports. The angular momentum conserved in the motion of the foot platforms of elliptical devices makes it is easier to maintain movement in the elliptical pattern as determined by the crank. For the user who wants to frequently change the direction of the elliptical motion, the substantial momentum of the flywheel makes it very difficult to change direction. A significant amount of force must be put into an elliptical device in order to change the direction from clockwise to counterclockwise, or vice versa.

An advantage of the present exercise device is that the user may easily change the length and frequency of the reciprocal stride with only a minimal input of force. The exercise device of the present invention has a movement that is reciprocating in nature, but it is not limited to the path created by a crank, nor is it inseparably tied to the momentum created by a flywheel. In order to reciprocate their stride, the user of the exercise device need only to move their foot/hand in an opposite direction with a force commensurate with changing the movement of the foot/hand during a normal walking or running gait. In contrast, the user of an elliptical device must strain to put in enough force to change the direction of rotation of the flywheel/crank/foot platform apparatus. Thus, the present exercise device offers a non-impact, natural-gait movement and requires input forces commensurate with the natural movement of walking or running.

The exercise device of the present invention contains braking device 324 (see FIGS. 6 and 6A) that acts as a flywheel, storing momentum imparted upon it during the power stroke. During the power stroke, force from the user is put into the exercise device by means of their weight, leg muscles and/or arm muscles. Braking device 324 and the drive pulley assembly only spin in one direction. Braking device 324 acts as a flywheel and stores inertia in order to facilitate the start of the power stroke. The inertial momentum of braking device 324 does not affect the minimal force necessary to change the reciprocal movement of foot platform assemblies 212, 214. It is only during the power stroke that braking device 324 is engaged and during which energy is imparted into braking device 324. On the return stroke of either foot support assembly 212, 214, one of the drive pulleys of the drive pulley assembly spins freely and does not affect the rotation of braking device 324. Since there is very little resistance during the return stroke, and because braking device 324 is acting as a store of inertia for the power stroke, only a small amount of force is necessary to initiate the reciprocal movement of exercise device 10.

IV. Foot Location Control Assembly

Figure 6:
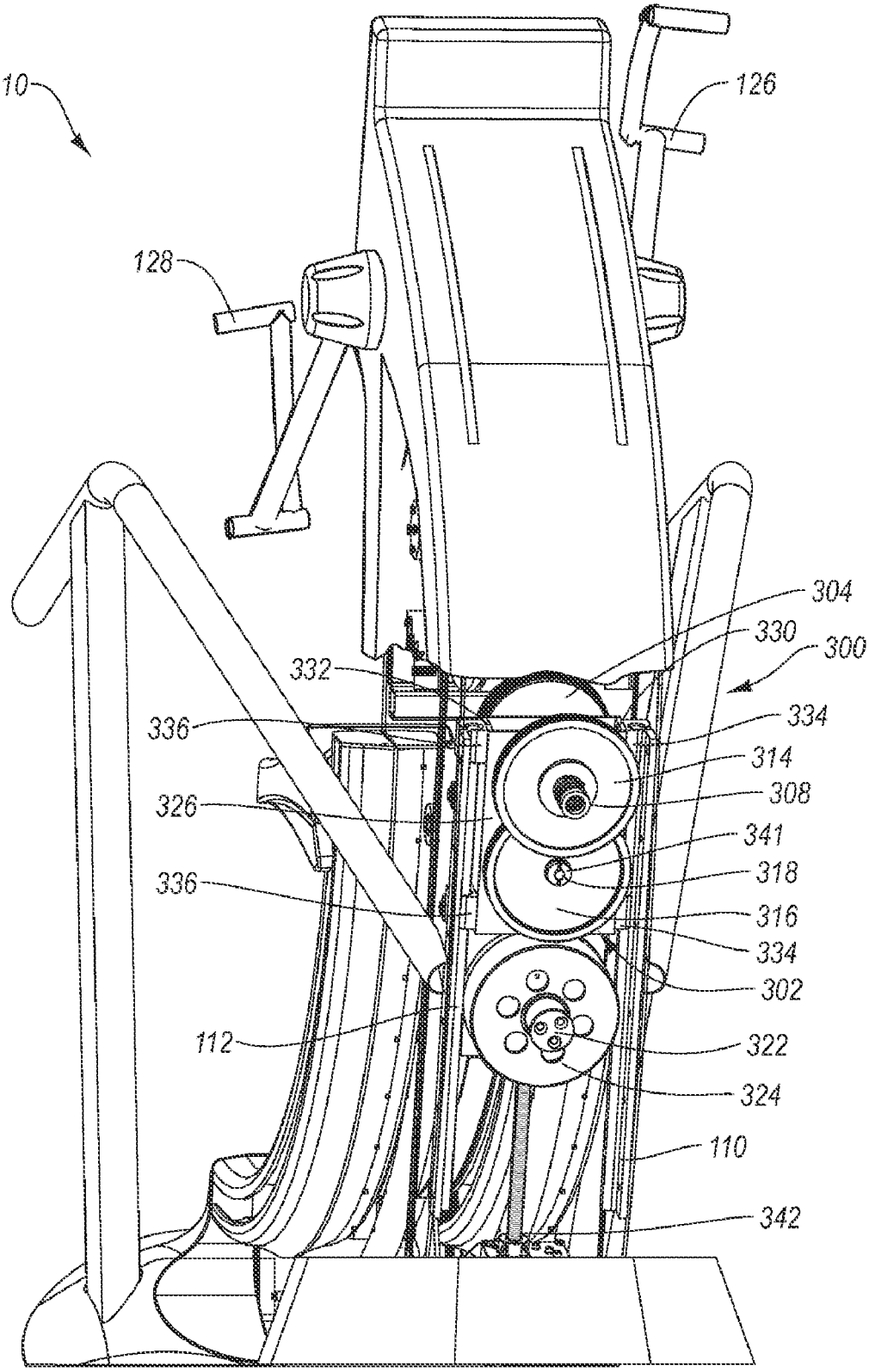
FIG. 6 is a front view of an embodiment of the exercise device of FIG. 1 depicting an embodiment of the foot location control assembly.
Figure 6A:
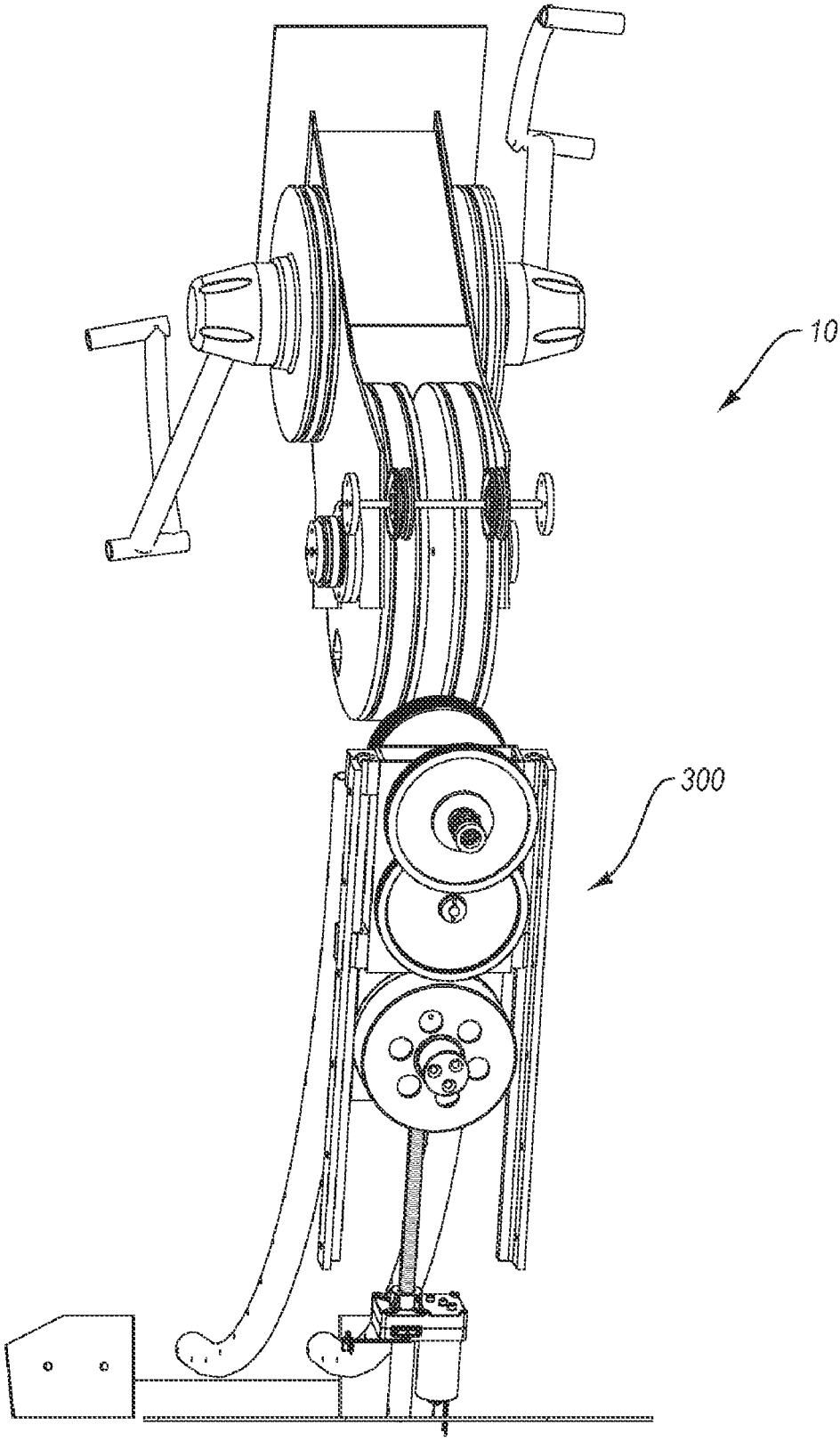
FIG. 6A is a view highlighting the resistance assembly and the foot location control assembly.

FIGS. 6-9A are a series of perspective views of exercise device 10, depicting foot location control assembly 300 and linkage assembly 400. FIGS. 6 and 6A are a front perspective view of exercise device 10 depicting foot location control assembly 300. Foot location control assembly 300 moves along a substantially vertical plane defined by the area in between first and second guide rails 110, 112. The upper and lower limit of travel available to foot location control assembly 300 are defined by the lengths of first and second guide rails 110, 112.

Foot location control assembly 300 includes a capstan 304 mounted to a pulley sled 302. Pulley sled 302 is a frame on which capstan 304 and other components are mounted, and which selectively moves up and down along guide members 110, 112 to adjust a foot location of foot support assemblies 212, 214.

Figure 9A:
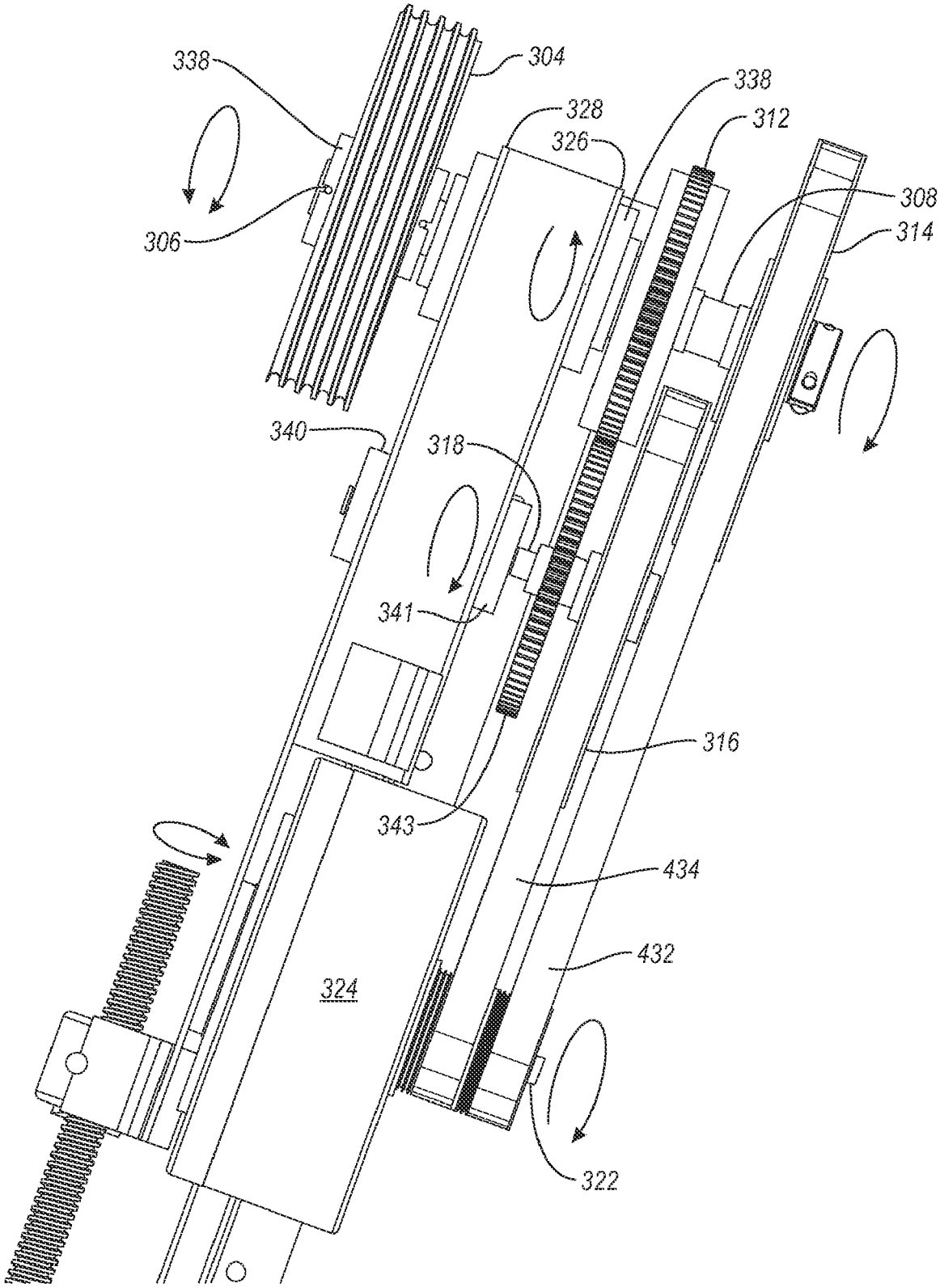
FIG. 9A is a close up perspective view showing several components related to the foot location control assembly of the exercise device of FIG. 1.

Capstan 304 may also be a drum pulley or other pulley or winch capable of winding or unwinding a length of cable. In an embodiment of exercise device 10, capstan 304 may be coupled via a flexible linkage, such as a cable, to a resistance assembly, e.g. to a one-way clutch 312, a first drive pulley 314, a second drive pulley 316, and a braking device 324, as depicted in FIGS. 9 and 9A. As will be discussed later, the pulleys and capstan of foot location control assembly 300 as well as other moving parts of exercise device 10 (e.g., foot support assemblies 212, 214, handles 126, 128, first and second drive pulleys 314, 316) are connected to one another by a flexible linkage mechanism having components described in linkage assembly 400.

Foot location control assembly 300 is mounted to guide rails 110, 112 by means of a front mounting plate 326, a rear mounting plate 328 (FIGS. 7, 7A, and 9A), a first side plate 330, and a second side plate 332 which collectively form pulley sled 302 to which a variety of components of the foot location control assembly are mounted. In another embodiment of exercise device 10, the resistance assembly is independently located from pulley sled 302.

Pulley sled 302 is movably connected to first guide rail 110 on a first side through a first pair of slide bearings 334. Drive pulley sled 302 is movably connected to second guide rail 112 on a second side through a second pair of slide bearings 336. One of slide bearings 334 and one of slide bearings 336 are mounted at the top end of each side plate 330, 332 and one of slide bearings 334 and one of slide bearings 336 are mounted at the bottom end of each side plate 330, 332.

In the illustrated exemplary embodiment of exercise device 10, a capstan main shaft 306 (FIGS. 7, 7A and 9A) is mounted through rear mounting plate 328 and through rear bearing mount plate 338 (FIG. 7), through front mounting plate 326 and through front bearing mount plate 338 (FIG. 9). Capstan main shaft 306 is connected to a rear end of one-way clutch 312, which includes a pressed-in one way clutch so as to accept rotation in only one direction, and also includes a series of evenly spaced gear teeth around its circumference (FIG. 9A). First one way clutch 312 is connected on its front side to a rear end of first clutch shaft 308. First clutch shaft 308 then ends at its front end by being mounted through first drive pulley 314.

Second drive pulley shaft 318 is mounted through rear mounting plate 328 through lower rear bearing mount plate 340, through front mounting plate 326 and through lower front bearing mount plate 341. Second drive pulley shaft 318 is mounted to a second drive pulley shaft gear 343, which includes a series of evenly spaced gear teeth that mesh with the evenly spaced teeth of first clutch gear 312. Second drive pulley shaft 318 ends at its front end by being mounted through second drive pulley 316.

In operation, the user moves foot support assemblies 212 and 214 up and down ramp assemblies 200 and 202. During each the power stroke of each respective foot support assembly, capstan 304 alternates between a clockwise and counterclockwise direction. Geared one-way clutch 312 includes a pressed-in one way clutch to allow it to rotate in only one direction (e.g. counterclockwise). First drive pulley 314 also includes a pressed-in one way clutch to allow it to rotate in only one direction, which is opposite that of geared one-way clutch 312 (e.g. clockwise). The teeth of geared one-way clutch 312 are coupled to gear 343, which causes gear 343 to spin in a direction opposite geared one-way clutch 312. Gear 343 is mounted on shaft 318, on which is also mounted second drive pulley 316. As such, the rotational inertia from one-way clutch 312 is reversed in direction by gear 343, and then used to drive second drive pulley 316, which in turn drives braking device 324. Such a configuration delivers all rotation inertia to braking device 324 in a single rotational direction.

First drive pulley 314 and second drive pulley 316 together form a drive assembly that drives braking device 324. Both first drive pulley 314 and second drive pulley 316 rotate in the same direction. The drive assembly imparts a one-way rotation upon a braking device shaft 322 that allows braking device 324 to spin in only one direction. First drive pulley v-belt 432 (FIGS. 9 and 9A) is connected at one end to first drive pulley 314 of foot location control assembly 300 and at a second end to braking device shaft 322. Second drive pulley v-belt 434 is connected at one end to second drive pulley 316 of foot location control assembly 300 and at a second end to braking device shaft 322.

A lead screw 342, an electric motor 344 and an actuator bracket 346 collectively form the actuator assembly that is responsible for moving foot location control assembly 300. Lead screw 342 is mounted at its bottom end to electric motor 344. Lead screw 342 is mounted at a position along its length to actuator bracket 346 which is mounted to rear mounting plate 328 of pulley sled 302. Actuator bracket 346 is threaded along its connection with lead screw 342 such that a rotation imparted upon lead screw 342 by electric motor 344 in either direction imparts an upward or downward movement of actuator bracket 346 and thus and upward or downward movement of foot location control assembly 300 as assembly 300 slides within guide rails 110, 112. Movement could alternatively be forward/rearward, depending on the mounting orientation of the foot location control assembly. By moving assembly 300 in one direction, the location of foot support assemblies 212, 214 is moved either upwards or downwards along respective ramp assemblies 200, 202, as will be discussed in further detail below.

V. Linkage Assembly

FIG. 9 is a perspective view of exercise device 10 that shows linkage assembly 400. Linkage assembly 400 may advantageously comprise a flexible linkage mechanism, for example, a series of pulleys and flexible links such as one or more cables that link the movement of handlebars 126, 128, through the foot location control assembly 300 to foot platform assemblies 212, 214 as they move along ramp assemblies 200, 202. The term cable is meant to include other elongate flexible linkages such as belts, chains, and ropes, for example.

Linkage assembly 400, as depicted in FIGS. 4 and 9, includes a first rear cable 402 and a second rear cable 404. For clarity, first rear cable 402 is only depicted in FIG. 4, but it is understood to be part of linkage assembly 400, which is further depicted in FIGS. 9, 9A, 10A and 10B. Each of first and second rear cables 402, 404 is fixed at one end to the framework 100 (e.g., rear stabilizer 116). Each of first and second rear cables 402, 404 is fixed at an opposite end to, respectively, a spring loaded drum pulley 406, 408 which form part of foot support assemblies 212, 214 respectively. First and second spring loaded drum pulleys 406, 408 are respectively connected to first and second foot platform brackets 216, 218. When first and second foot platform assemblies 212, 214 move along respective first and second ramp assemblies 200, 202, the length of cable wound upon first and second spring loaded drum pulleys 406, 408 changes. When first foot support assembly 212 or second foot support assembly 214 is at its maximum forward position, the amount of wound cable upon respective first and second spring loaded drum pulleys 406, 408 is at its minimum. When first foot support assembly 212 or second foot support assembly 214 is at its maximum rearward position, the amount of wound cable upon respective first and second spring loaded drum pulleys 406, 408 is at its maximum. Cables 402, 404 can provide a desired amount of tension and/or resistance to linkage assembly 400 and/or movement of foot support assemblies 212, 214 and/or can help ensure a smooth, stable and consistent exercise motion.

Figure 7:
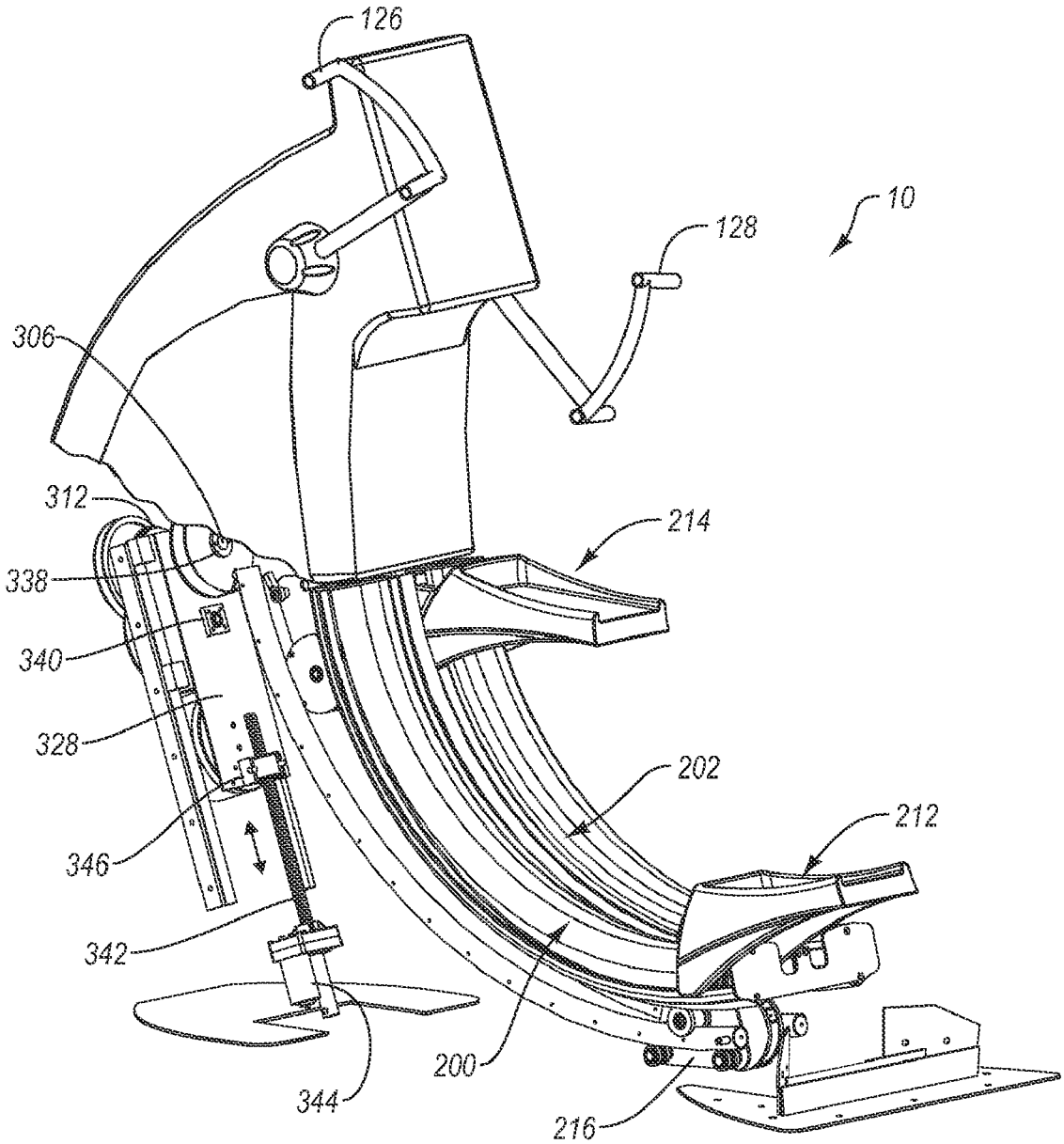
FIG. 7 is a perspective view depicting an embodiment of the exercise device of FIG. 1 having the spring loaded drum pulley of the foot support assemblies.
Figure 7A:
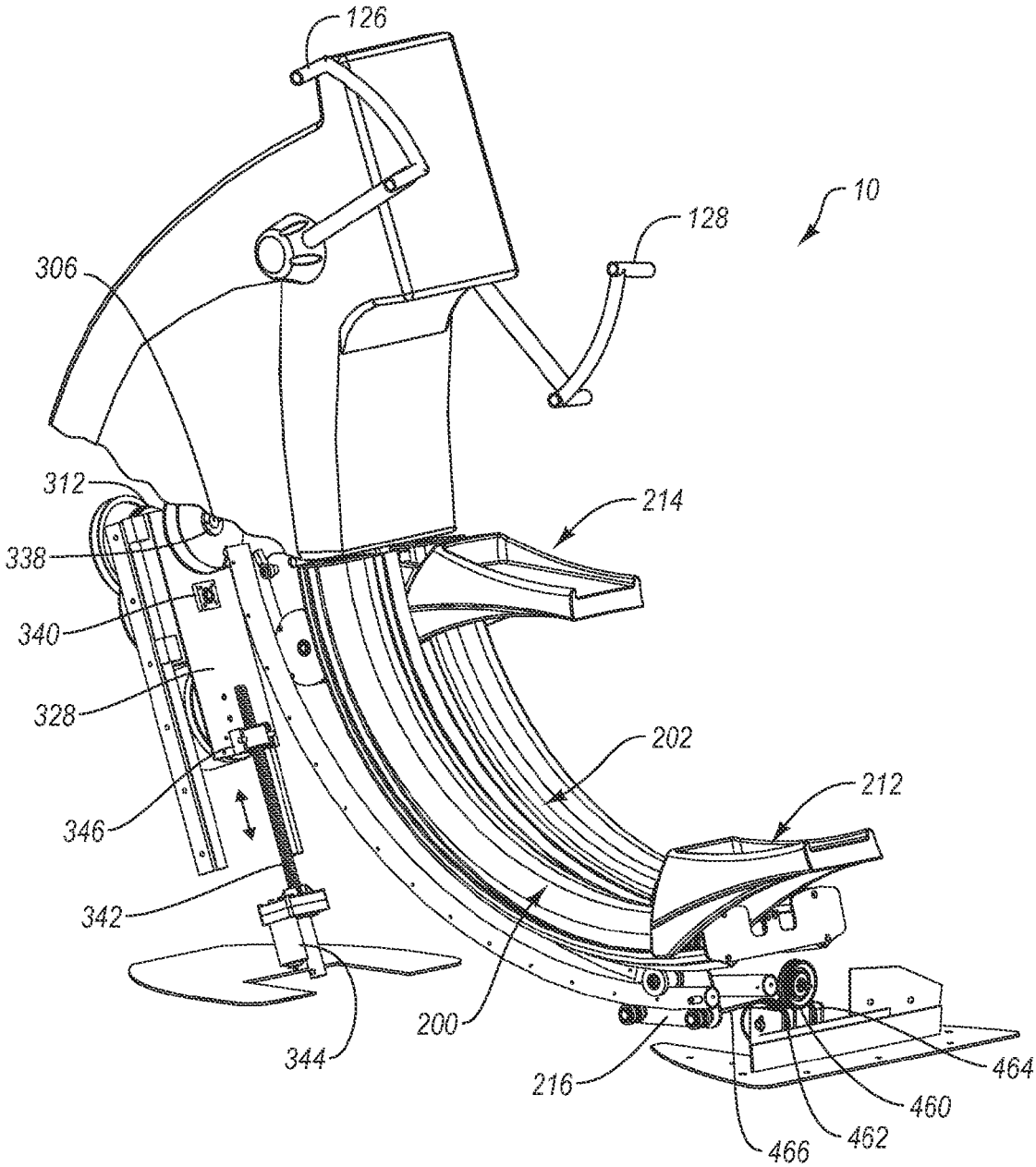
FIG. 7A is a perspective view depicting an embodiment of an exercise device similar to FIG. 1, but having a series of pulleys towards the rear of the exercise device, rather than having a spring loaded drum pulley.
Figure 8:
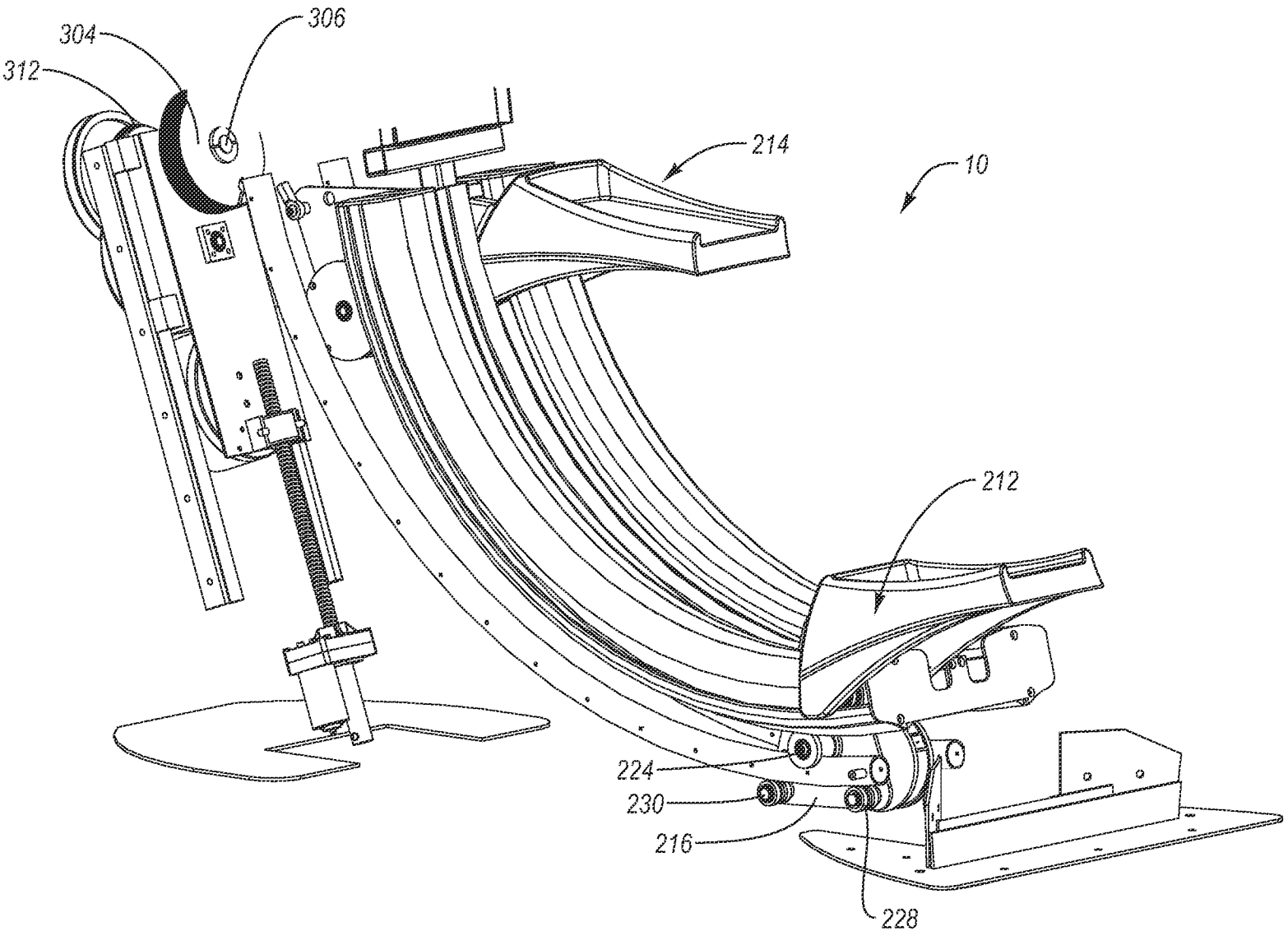
FIG. 8 is a perspective view depicting the ramp assemblies of the exercise device of FIG. 1.

As depicted in an embodiment of exercise device 10 in FIG. 7A, rather than employing rear cables 402, 404, a single rear cable 466 is connected to the rear end of each foot support assemblies 212, 214. Single rear cable 466 is connected to the rear end of a first foot support assembly 212, passes through a first rear transverse pulley 462, a middle rear transverse pulley 460, and a second rear transverse pulley 464, then connects to the rear end of a second foot support assembly 214.

A first front cable 410 and a second front cable 412 (see FIGS. 9 and 10A-10B) are attached at their respective rear ends to the front side of respective foot platform brackets 216, 218 at the front cable attachments to each of foot platform brackets 216, 218. For example, front cable attachment 217 is depicted on foot platform bracket 218 in FIG. 4 (the respective front cable attachment for foot platform bracket 216 is not depicted). A first front cable 410 and a second front cable 412 are attached at their respective opposite ends to a first groove 436 of a first large drive pulley 424 and a first groove 440 of a second large drive pulley 426.

The first end of a capstan cable 414 is attached to a second groove 438 of a first large drive pulley 424. Capstan cable 414 is then routed through a first transverse pulley 428 that guides capstan cable 414 onto capstan 304 of foot location control assembly 300. Capstan cable 414 wraps around capstan 304. Capstan cable 414 then travels through a second transverse pulley 430 and is directed into a second groove 442 of second large drive pulley 426, where the second end of capstan cable 414 is fixed.

First handle bar 126 is fixed to a first handle bar pulley 416 at an ergonomically beneficial angle. Second handle bar 128 is likewise fixed to a second handle bar pulley 418 at an ergonomically beneficial angle. A first handle bar flexible linkage (e.g. cable 420) is connected at one end to first handle bar pulley 416 and at another end to first large drive pulley 424. Likewise, a second handle bar flexible linkage (e.g., cable 422) is connected at one end to a second handle bar pulley 418 and at another end to a second large drive pulley 426.

Figure 10A:
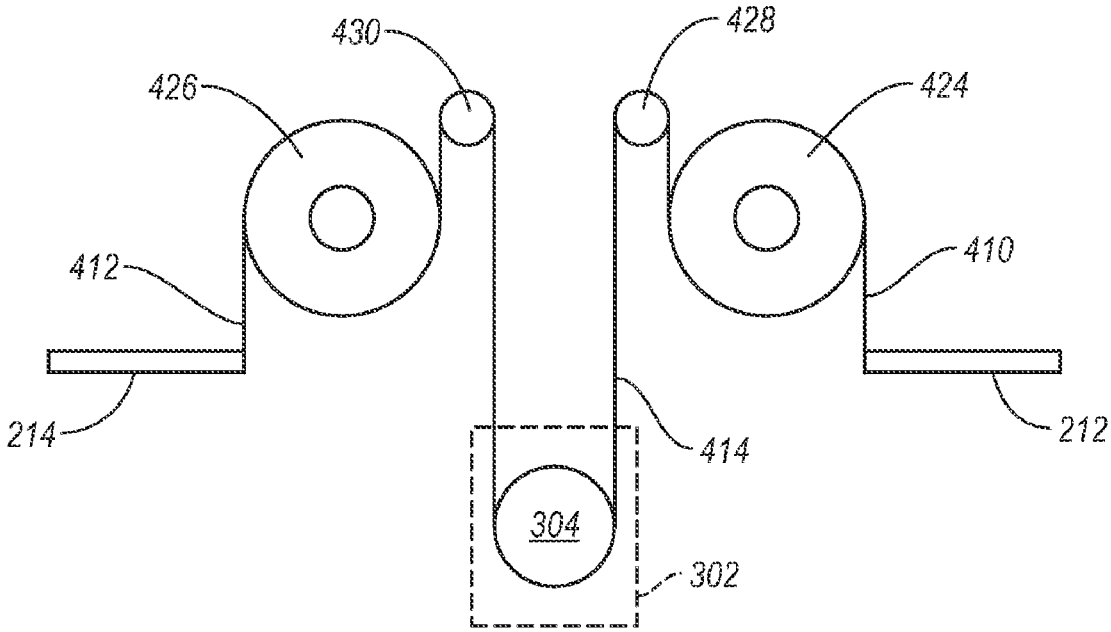
FIGS. 10A and 10B are schematic depictions of the variable positions of the foot location control assembly of the exercise device of FIG. 1.
Figure 10B:
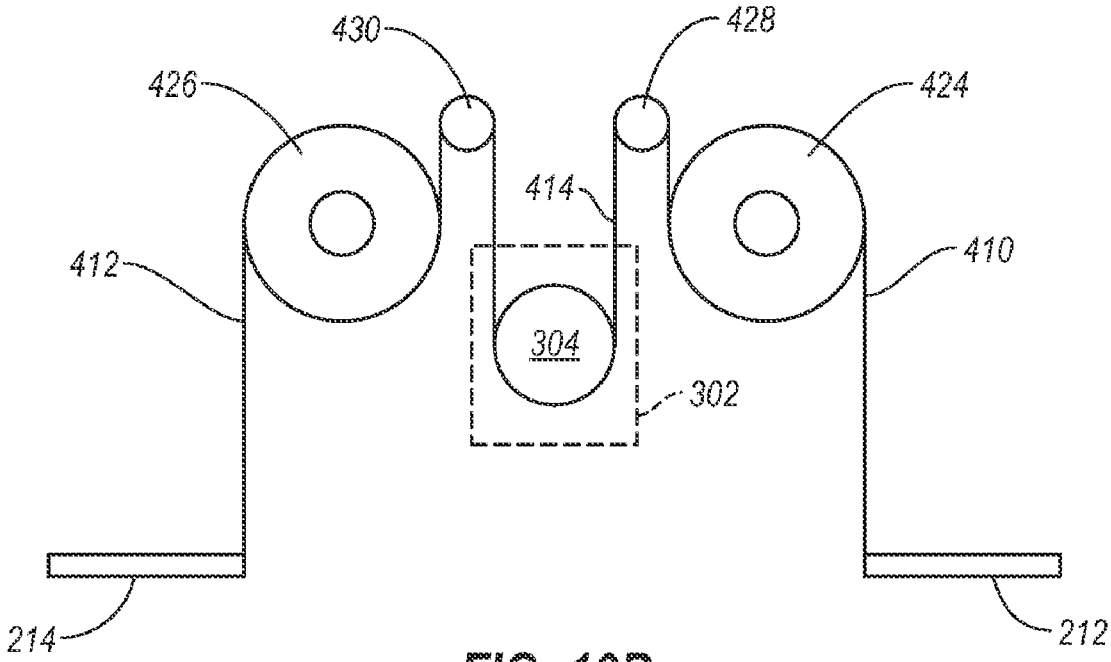

FIGS. 10A and 10B depict a schematic of the movement of capstan 304 and pulley sled 302 and the effect on the front terminus of movement of foot platform assemblies 212, 214.

The effect of varying the length of unwound cable between front cables 410, 412 and capstan cable 414 is to vary the termini of travel of foot platform assemblies 212, 214 along ramp assemblies 200, 202 and to thereby vary the stride length of foot support assemblies 212, 214. The amount of unwound cable between front cables 410, 412 and capstan cable 414 is adjusted through the raising and lowering of foot location control assembly 300. As depicted schematically in FIG. 10B, when pulley sled 302 (dotted-in for clarity) and capstan 304 of foot location control assembly 300 are at their maximum height relative to the supporting surface, the fixed length of the cables allows the lower terminus of movement of each of foot platform assemblies 212, 214 along ramp assemblies 200, 202 to be at its most rearward position along ramp assemblies 200, 202. In this position, as depicted in FIG. 10B, the exercise motion imparted upon a user is more like that of a classical elliptical machine, as the user's exercise motion is primarily along the horizontal aspect of ramp assemblies 200, 202.

As depicted schematically in FIG. 10A, when pulley sled 302 (dotted-in for clarity) and capstan 304 of foot location control assembly 300 are at their minimum height relative to the supporting surface, the fixed length of the cables forces the lower termini of movement of foot platform assemblies 212, 214 along ramp assemblies 200, 202 to be at a position which is higher relative to the configuration shown in FIG. 10B. In this position, as depicted in FIG. 10A, the exercise motion imparted upon a user is more like that of a stair-stepper exercise machine. The user's exercise motion is primarily along the vertical aspect of ramp assemblies 200, 202. Motion of pulley sled 302 either up or down adjusts the effective length of the cable so as to adjust the maximum achievable stride length of the foot support assemblies. When pulley sled 302 is positioned at a minimum height, the cable linkage mimics that of a shorter cable compared to if the pulley sled is positioned upward of this minimum height position. This adjustment feature of the pulley sled 302, capstan 304 and the cable 414 alters the effective length of the cable.

Thus foot location control assembly 300 enables exercise device 10 to operate more like an elliptical exercise device and/or to operate more like a stair-stepper device as desired by the user. Foot location control assembly 300 and/or the resistance assembly described herein can be selectively controlled, for example through the use of a user controlled console and associated electronics mounted on framework 100.

Foot location control assembly 300 described in conjunction with FIG. 6-10B is an example of an adjustment assembly for adjusting the neutral body position of the user of the exercise device with respect to a support surface. As such, foot location control assembly 300 is an example of means for adjusting the neutral body position of the user of the exercise device with respect to a support surface. Thus, one example of means for adjusting the neutral body position of a user may comprise a foot location control assembly (e.g. a capstan 304 mounted on a pulley sled 302 and a lead screw 342, electric motor 344, and actuator bracket 346 as described above for assisting in moving pulley sled 302 along guide rails 110, 112). Another example of means for adjusting the neutral body position of the user of the exercise device with respect to a support surface is a lead screw that may be used independent of a pulley sled. Another example of means for adjusting the neutral body position of the user of the exercise device with respect to a support surface is an adjustable pulley system that may similarly be used independent of a lead screw that may be used to alter the orientation of the foot platforms of assemblies 212, 214, thereby adjusting the neutral body position of the user. For example, capstan 304 and pulley 414 can be configured so as that more or less of the length of cable 414 is wound around capstan 304 so as to move foot platforms of assemblies 212, 214 upward or downward along ramps 200, 202, adjusting the neutral body position of the user of the exercise device relative to a support surface. In another example an adjustable pulley system may be adjustably moveable with respect to framework 100, such that when the pulley is moved upward or downward along the framework the position of the foot platforms of assemblies 212, 214 move with respect to the framework 100, thereby adjusting the neutral body position of the user of the exercise device with respect to a support surface. Other examples of means for adjusting the neutral body position of the user of the exercise device with respect to a support surface include, but are not limited to, gear assemblies, hydraulic assemblies, an elastic resistance assemblies, and the like.

The neutral position of the present exercise device is a position in which the foot platforms 211, 213 are disposed laterally adjacent to one another (i.e., neither is "ahead" or "behind" the other). When the exercise device is in the neutral position, the user's body is in the neutral body position. The user's body may experience a variety of different positions depending upon how the neutral body position is adjusted. For example, changing the neutral body position may vary the muscles worked and/or intensity of the workout. Different body positions impart different characteristics to the exercise movement of the present exercise device. For example, a user may place more of a burden on their arms or legs, respectively, by adjusting the neutral body position.

Figure 11A:
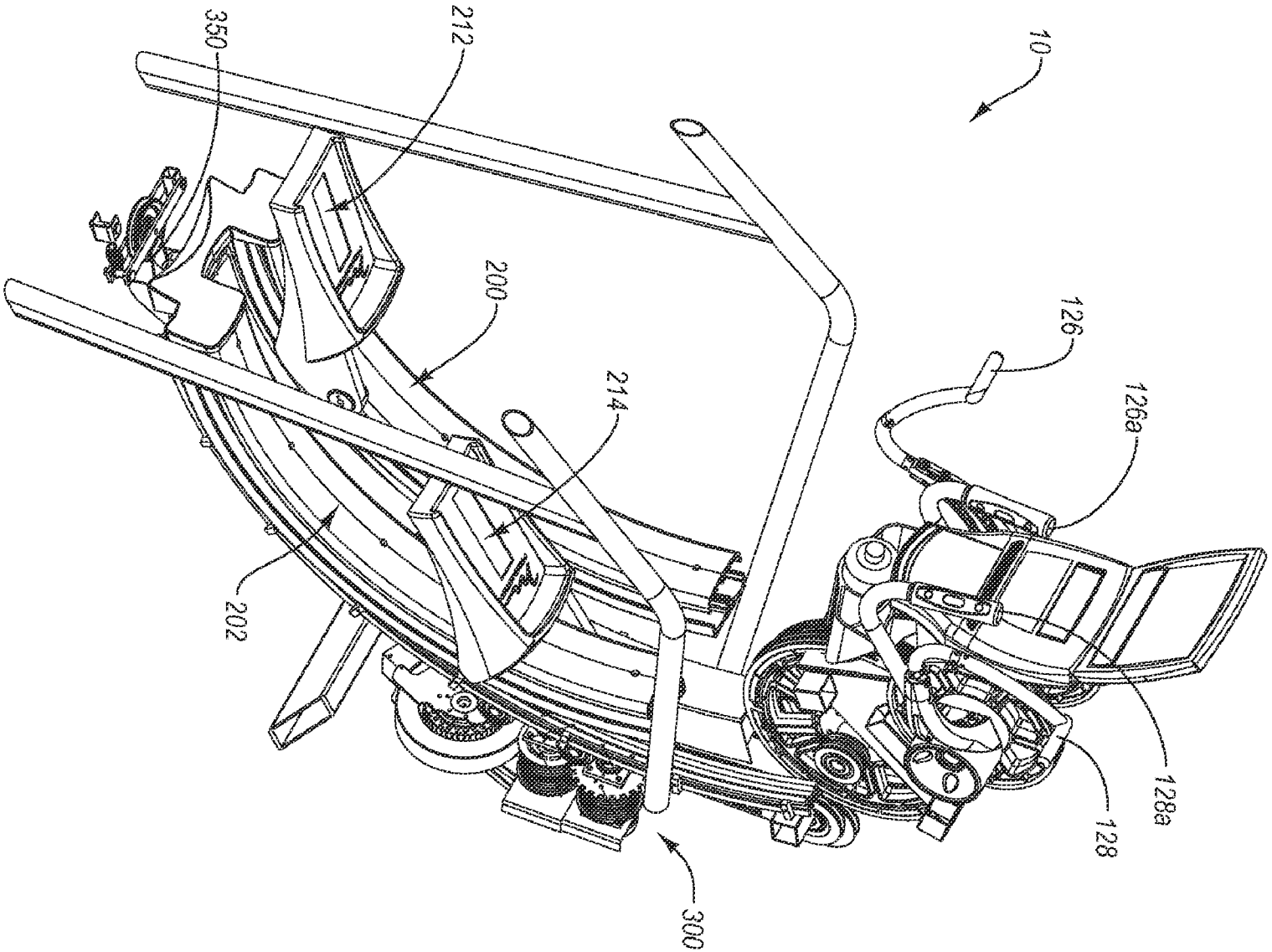
FIGS. 11A-11C illustrate an alternative embodiment of the exercise device of the present invention in which cable tension within the linkage system is maintained by a lower cable and pulley assembly rather than a spring loaded drum pulley as described in previous Figures.
Figure 11B:
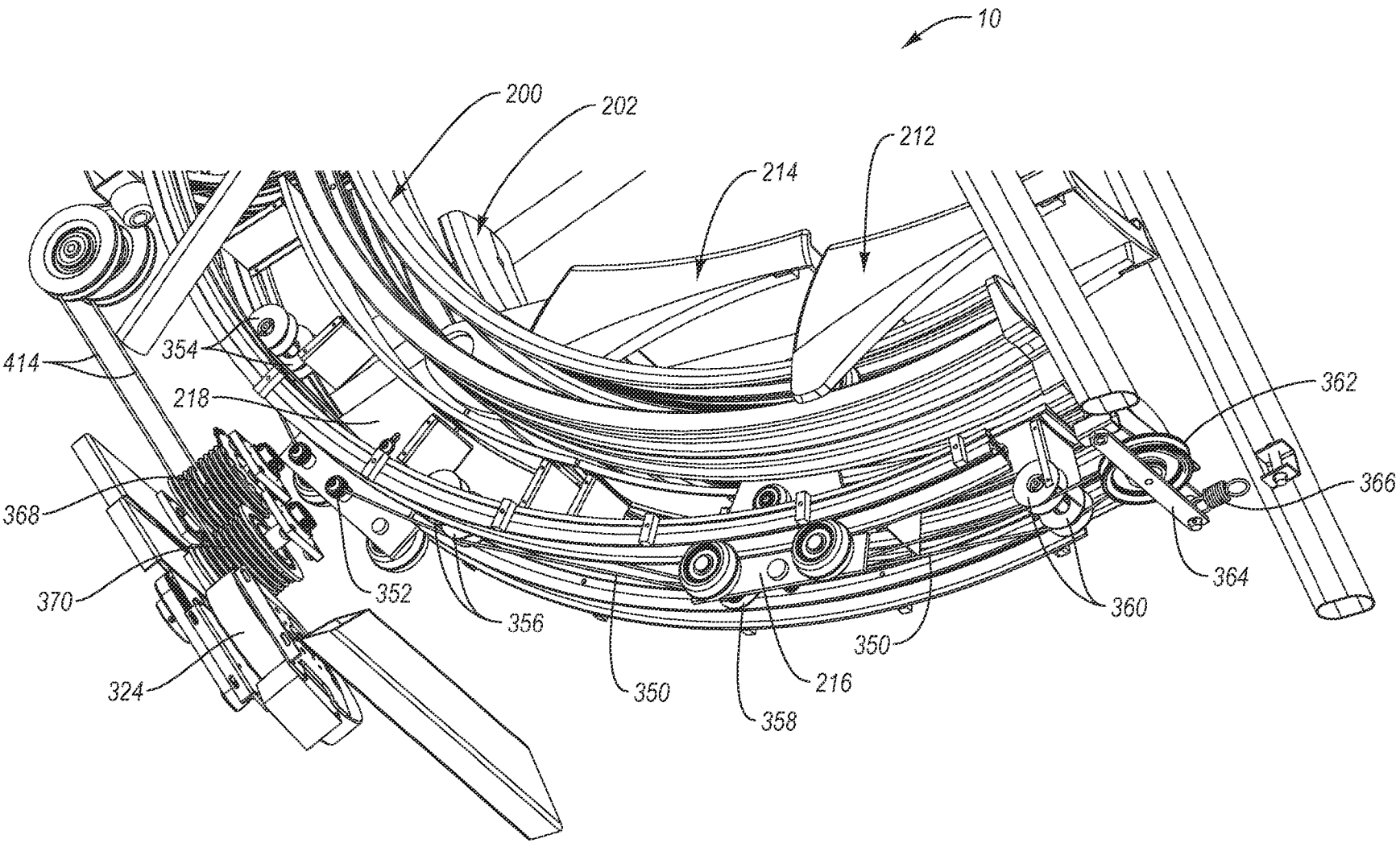
Figure 11C:
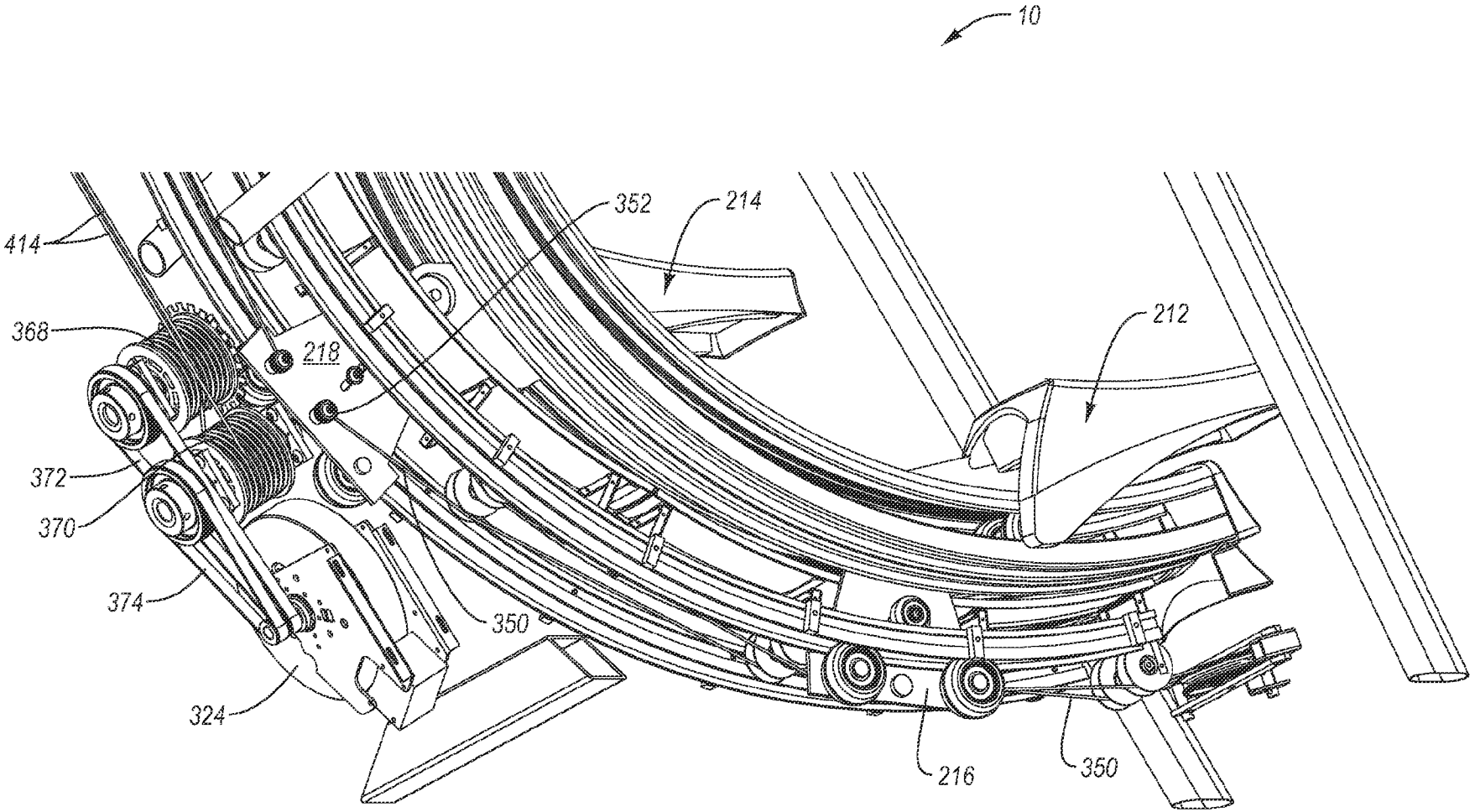
Figure 1:
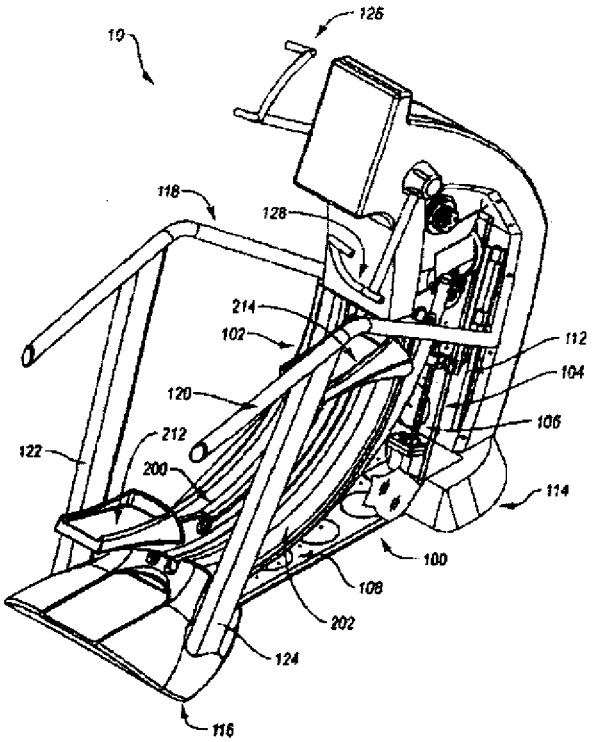
Figure 5A:
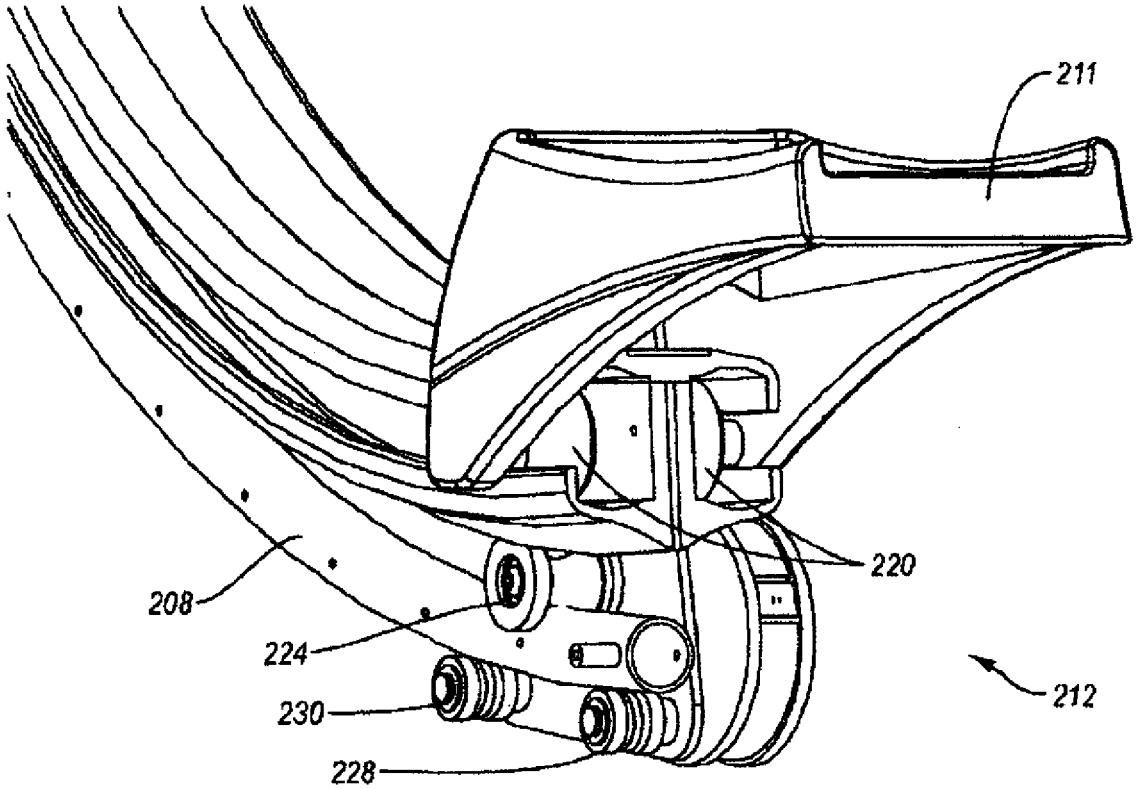
Figure 5B:
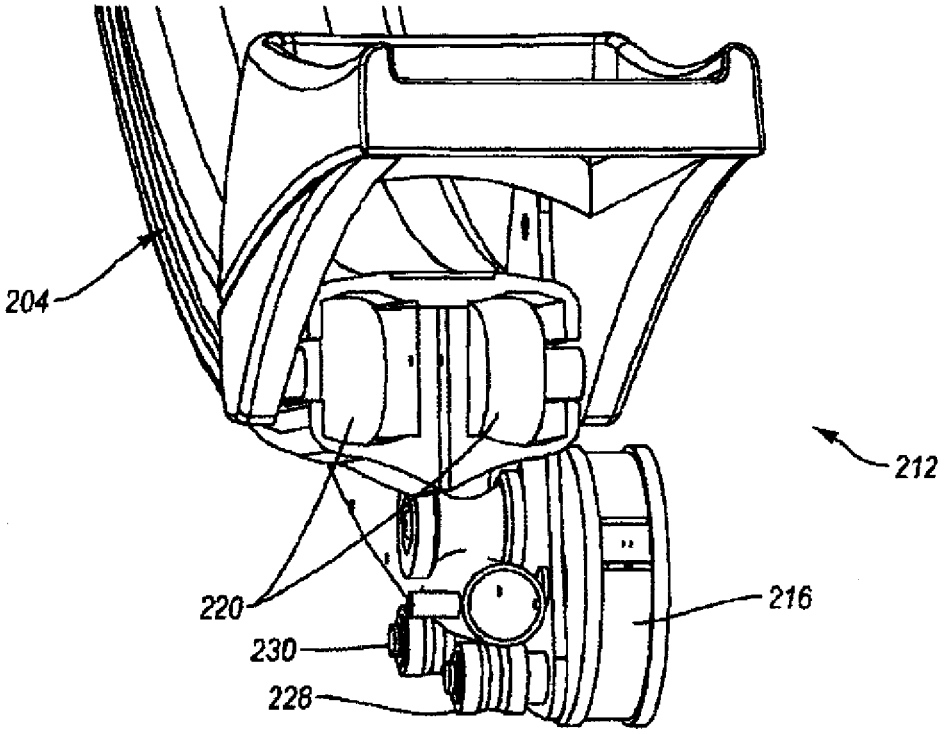
Figure 11A:
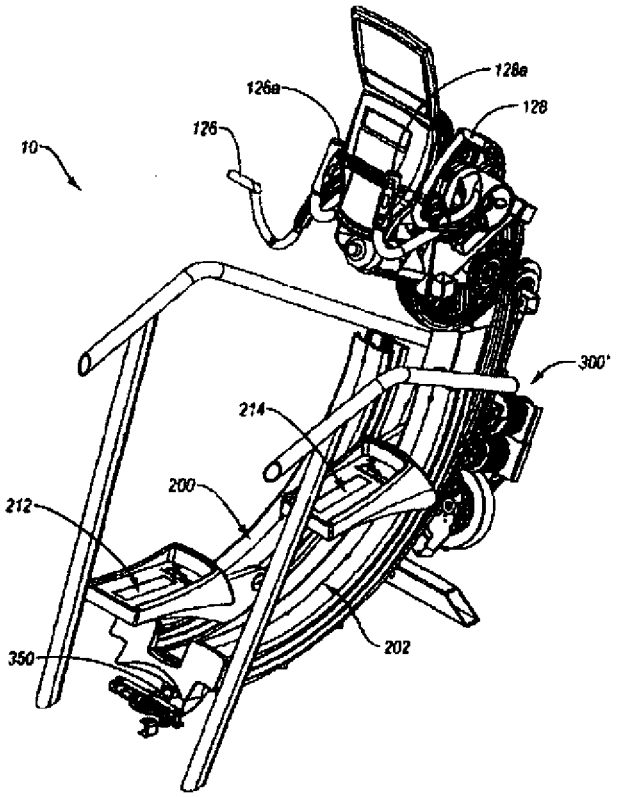

FIGS. 11A-11C illustrate an alternative embodiment of the exercise device of the present invention in which cable tension within the flexible linkage system may be maintained by a lower cable and pulley assembly (e.g., rather than or in addition to the spring loaded drum pulley and/or rear cable described previously). In addition, the embodiment illustrated in FIGS. 11A-11C is illustrated as not including a foot location control assembly which is vertically adjustable, but rather in which the components which perform the function of the pulley sled components described in the other embodiments are fixed (i.e., not vertically adjustable so as to alter the neutral position of the foot platform assemblies). Such an embodiment may be less complex and although it may not offer the full range of adjustments as the embodiments described above, such an embodiment also may have reduced cost, so as to be more suitable for home use.

As perhaps best seen in FIGS. 11B-11C, a single lower cable 350 maintains tension on the cables of the flexible linkage system and on the foot platform assemblies during movement of the foot platform assemblies. One end of cable 350 is attached to an inwardly oriented surface of bracket 218 through, for example, extension spring 352 and an associated pivoting transverse mount. The inclusion of extension spring 352 aids in absorption of forces applied to the cable linkage as a result of the reciprocal movement of foot platforms 212, 214, as well as to minimize cable slack within the linkage system. The second end of cable 350 is connected to bracket 216 in a similar manner. Thus cable 350 couples first foot support assembly 212 with second foot support assembly 214, linking the foot platforms (e.g. 211, 213) of each foot support assembly to cable 350 through brackets 216, 218, to which each end of cable 350 is attached.

The central portion of lower cable 350 (i.e., between each end attached to brackets 216, 218) is guided by a series of pulleys, which guide the cable as it runs from one bracket 218 to the other bracket 216. In the illustrated example, four pairs of v-groove pulleys (i.e., 8 pulleys total) are mounted below ramps 200 and 202 at approximately evenly spaced intervals. Each pair of pulleys may be mounted on a transverse shaft, which in turn may be mounted to a bracket which is attached to the frame and/or ramps 200, 202. The illustrated example includes a pair of front pulleys 354, a pair of first center pulleys 356, a pair of second center pulleys 358 disposed rearward relative to first center pulleys 356, and a pair of rear pulleys 360. A single transverse pulley 362 is mounted rearward of pulleys 360 as part of an idler assembly. The idler assembly includes pulley 362, a mounting arm 364 and an idler spring 366. From a first end attached to bracket 218, cable 350 runs downward so as to contact the lower circumference of one of first center pulleys 356, continuing downward through one of second center pulleys 358 and through one of rear pulleys 360. Cable 350 then passes around transversely disposed idler pulley 362. Idler pulley 362 reorients the cable 350 towards a forward direction. Idler pulley 362 is mounted on mounting arm 364, which is coupled to idler spring 366. The idler assembly accounts for some variability within the cable system so as to maintain cable tension.

Leaving pulley 362, cable 350 then substantially retraces the same path in reverse, contacting the other of rear pulleys 360 and finally terminating at bracket 216. In the position illustrated in FIGS. 11B and 11C, bracket 216 is located at a position corresponding to slightly lower than second center pulley 358, while bracket 218 is illustrated at a position corresponding to a higher position on ramp 200 relative to first and second center pulleys 358, 356. As illustrated, cable 350 does not contact all of pulleys 354, 356, 358 and 360 at all foot pedal positions, but only contacts those pulleys which lie downward of ramps 200, 202 relative to the position of brackets 216, 218. For example, in the illustrated bracket and foot pedal positions, cable 350 does not contact either of front pulleys 354, and cable 350 contacts only one of first center pulleys 356 and one of second center pulleys 358. Both rear pulleys 360 are contacted by cable 350. If either foot pedal were moved up to the extreme high end of ramps 200, 202, cable 350 would contact one of front pulleys 354. As the foot pedals are reciprocally coupled, if one foot pedal were "high" the other would be "low" relative to the "high" pedal.

Lower cable 350 reciprocally relates the rearward/forward movement of each foot platform assembly to one another. As a result of the cable coupling of brackets 216 and 218 through cable 350, slack within the flexible cable system is minimized and the foot support platforms remain reciprocally linked during both the power stroke and relaxing stroke of any exercise movement. Lower cable 350 is an example of another reciprocal coupling of the foot support assemblies, as they may also be coupled by a flexible cable linkage as described in conjunction with FIG. 9.

In addition, it will be noted that the embodiment of FIGS. 11A-11C includes components for performing the function of the foot location control assembly which are fixedly mounted to the frame of device 10, rather than mounting the components on a pulley sled with is vertically adjustable. Rather than including the pulley sled components (e.g. capstan 304, first drive pulley 314, one way clutch 312, second drive pulley 316, and second drive pulley shaft gear 343) as described in conjunction with FIGS. 9 and 9A, the embodiment of FIGS. 11A-11C includes alternative structure. Assembly 300' includes a first capstan 368 around which cable 414 is wound in one direction (e.g. counter-clockwise) and a second capstan 370 around which cable 414 is wound in the other direction (e.g., clockwise). A first drive belt 372 couples first capstan 368 with breaking device 324 (e.g., an eddy current brake), while a second drive belt 374 couples second capstan 370 with breaking device 324. Each capstan 368 and 370 includes a one way clutch to ensure that belts 372 and 374 drive breaking device 324 in a single direction. Although described as being fixedly mounted to the frame, it will be understood that the alternative assembly comprising capstans 368, 370, belts 372, 374 and braking device 324 may alternatively be mounted onto a pulley sled which is vertically adjustable, as previously described.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed is:

1. An exercise apparatus comprising:

a framework;

at least one curved ramp assembly mounted to said framework;

a pair of foot support assemblies, each foot support assembly being movably coupled to said at least one curved ramp assembly;

a resistance assembly coupled to said foot support assemblies so as to provide resistance against movement of said foot support assemblies by a user; and means for adjusting a maximum stride length of said foot support assemblies, said means for adjusting being selectively operable to adjust a maximum stride length between said foot support assemblies along said at least one ramp assembly, said means for adjusting being selectively operable to alter an upper terminus and a lower terminus of each of said foot support assemblies, wherein the upper terminus and the lower terminus can be altered during exercise without altering the stride length.

2. The exercise apparatus of claim 1, wherein said means for adjusting a maximum stride length links a first foot support to a second foot support whereby said first and second foot support assemblies move in a reciprocal relationship to one another.

3. The exercise apparatus of claim 1, wherein said means for adjusting a maximum stride length of said foot support assemblies comprises a foot location control assembly.

4. The exercise apparatus of claim 3, wherein said foot location control assembly comprises a cable and pulley system, and an actuator linked thereto.

5. The exercise apparatus of claim 1, wherein each foot support assembly includes a foot support platform and a foot platform bracket, said foot support platform being pivotally connected to said foot platform bracket.

6. The exercise apparatus of claim 5, wherein:

each foot support platform is movably coupled to said at least one ramp assembly by at least one wheel, each wheel being capable of rolling along a surface of a ramp of said at least one ramp assembly; and wherein each foot platform bracket is movably coupled to a respective guide member said guide member being positioned below a respective ramp of said at least one ramp assembly.

7. The exercise apparatus of claim 5, wherein each foot platform bracket is movably coupled to a respective guide member by an upper bracket wheel mounted to said foot platform bracket and at least one lower bracket wheel mounted below said upper bracket wheel such that said upper bracket wheel rests upon a top surface of said guide member and said lower wheel contacts and rolls along a bottom surface of said guide member.

8. An exercise apparatus comprising:

a framework;

at least one ramp assembly mounted to said framework, said at least one ramp assembly comprising a ramp having a front end, a rear end, and a first radius, and a guide member having a front end, a rear end, and a second radius, said guide member being positioned below and extending substantially along the length of said ramp, wherein said rear end of said guide member is separated from said rear end of said ramp by a first distance, and wherein said front end of said guide member is separated from said front end of said ramp by a second distance, said second distance being greater than said first distance; and a pair of foot support assemblies, each foot support assembly being movably coupled to said at least one ramp assembly, wherein a first foot support assembly of said pair of foot support assemblies is movably coupled to said ramp and said guide member.

9. The exercise apparatus of claim 8, wherein said first radius is different from said second radius.

10. The exercise apparatus of claim 8, wherein said guide member is positioned substantially directly below said ramp.

11. The exercise apparatus of claim 8, wherein said at least one ramp assembly comprises a first ramp assembly and a second ramp assembly.

12. The exercise apparatus of claim 11, wherein one of said pair of foot support assemblies is coupled to said first ramp assembly and the other of said pair of foot support assemblies is coupled to said second ramp assembly.

13. The exercise apparatus of claim 8, wherein each foot support assembly includes a foot support platform and a foot platform bracket, said foot platform bracket being pivotally connected to said foot support platform.

14. The exercise apparatus of claim 13, wherein said foot platform bracket comprises at least one wheel for coupling with said ramp or said guide member.

15. The exercise apparatus of claim 8, wherein said first radius of said ramp and said second radius of said guide member of said at least one ramp assembly are configured to provide an ergonomic articulation to said pair of foot support assemblies.

16. The exercise apparatus of claim 13, wherein said pair of foot support assemblies are configured such that an angle of inclination of each respective foot platform changes when said foot support assemblies are moved from one position along said at least one ramp assembly to another position along said at least one ramp assembly.

17. The exercise apparatus of claim 13, wherein said ramp of said ramp assembly has a curved shape such that a distance traveled by said foot platform along said ramp is different from a distance traveled by said foot platform bracket along said guide member so as to impart an ergonomic articulation upon said foot platforms as said foot platforms travel along said at least one ramp assembly.

18. An exercise apparatus comprising:

a framework;

a first ramp assembly mounted to said framework, said first ramp assembly comprising a first ramp having a front portion, a rear portion, and a first curvature and a first guide member having a front portion, a rear portion, and a second curvature, said first ramp being positioned above and extending along the length of said first guide member, wherein said rear portion of said first guide member is separated from said rear portion of said first ramp by a first distance, and wherein said front portion of said first guide member is separated from said front portion of said first ramp by a second distance, said second distance being greater than said first distance;

a second ramp assembly mounted to said framework, said second ramp assembly comprising a second ramp having a front portion, a rear portion, and a first curvature and a second guide member having a front portion, a rear portion, and a second curvature, said second ramp being positioned above and extending along the length of said second guide member, wherein said rear portion of said second guide member is separated from said rear portion of said second ramp by said first distance, and wherein said front portion of said second guide member is separated from said front portion of said second ramp by said second distance; and a pair of foot support assemblies, one foot support assembly being movably coupled to said first ramp and to said first guide member, and the other of said foot support assemblies being movably coupled to said second ramp and to said second guide member.

19. The exercise apparatus of claim 18, wherein said first curvature of said first ramp assembly differs from said second curvature of said first guide member; and wherein said first curvature of said second ramp assembly differs from said second curvature of said second guide member.

20. The exercise apparatus of claim 18, wherein said first foot support assembly comprises a first foot platform and a first foot support bracket pivotally coupled thereto, and wherein said second foot support assembly comprises a second foot platform and a second foot support bracket pivotally coupled thereto, each of said brackets comprising a plurality of wheels and being movably coupled to a respective guide member.

21. An exercise apparatus comprising:

a framework;

at least one curved ramp assembly mounted to said framework, said at least one curved ramp assembly including a substantially horizontal portion and a substantially vertical portion;

a pair of foot support assemblies, each foot support assembly being movably coupled to said at least one curved ramp assembly;

a foot location control assembly coupled to said pair of foot support assemblies and configured to selectively constrain the movement of said foot support assemblies to be within said substantially horizontal portion of said at least one ramp assembly when in a first configuration and to constrain the movement of said foot support assemblies to be within said substantially vertical portion of said at least one ramp assembly when in a second configuration, wherein said foot location control assembly can change between said first and second configurations without movement of said at least one curved ramp relative to said framework.

22. The exercise apparatus of claim 21, wherein said foot location control assembly is configured to be selectively movable to adjust an upper and lower terminus of movement of said foot support assemblies along said at least one ramp assembly.

23. The exercise apparatus of claim 21, wherein said foot location control assembly is coupled to said pair of foot support assemblies and configured to selectively constrain the movement of said foot support assemblies along said at least one ramp assembly to be at least partially within said upper portion of said ramp assembly and at least partially within said lower portion of said ramp assembly.

24. The exercise apparatus of claim 21, wherein said foot location control assembly links a first foot support assembly to a second foot support assembly such that said first and second foot support assemblies move in a reciprocal relationship to one another.

25. The exercise apparatus of claim 21, wherein said foot location control assembly comprises a cable and pulley system and an actuator linked thereto.

26. The exercise apparatus of claim 25, wherein said cable and pulley system comprises at least one cable and at least one pulley, said at least one pulley being mounted on a pulley sled, and wherein said at least one cable is linked to said at least one pulley.

27. The exercise apparatus of claim 26, wherein said pulley sled is movable relative to said framework by said actuator.

28. The exercise apparatus of claim 27, wherein said actuator comprises an actuator bracket and a motor assembly.

29. The exercise apparatus of claim 28, wherein said motor assembly comprises a motor and a lead screw linked to said motor, said actuator bracket being threadedly mounted on said lead screw, said actuator bracket being mounted to said pulley sled.

30. The exercise apparatus of claim 29, wherein the rotation of said lead screw by said motor causes movement of said pulley sled relative to said framework.

31. The exercise apparatus of claim 29, wherein said pulley sled is mounted to said framework by a pair of spaced apart guide rails mounted to a first side panel and a second side panel of said framework.

32. An exercise apparatus comprising:

a framework;

at least one ramp assembly mounted to said framework, said at least one ramp assembly including a curved configuration;

a pair of foot support assemblies, each foot support assembly being movably coupled to said at least one ramp assembly; and a resistance assembly coupled to said foot support assemblies so as to provide resistance against movement of said foot support assemblies by a user, wherein said resistance assembly is mounted to a cable and pulley system comprising a pulley sled, said pulley sled being adjustable with respect to said framework, wherein adjustment of said pulley sled with respect to said framework enables adjustment of a lower terminus and an upper terminus of each foot support assembly of said pair of foot support assemblies, wherein the upper terminus and the lower terminus can be adjusted during exercise without altering the stride length.

33. The exercise apparatus of claim 32, wherein the resistance assembly comprises:

a capstan mounted on a first shaft, said first shaft being mounted to said pulley sled;

a first one-way clutch mounted upon said first shaft;

a first drive pulley mounted upon said first shaft, said first drive pulley including a second one-way clutch;

a gear mounted upon a second shaft, said second shaft being mounted to said pulley sled, said gear being coupled with said first one-way clutch;

a second drive pulley mounted upon said second shaft;

said first drive pulley and said second drive pulley being coupled to a braking device.

34. The exercise apparatus of claim 33, wherein said braking device comprises one or more of a freewheel and an eddy brake.

35. An exercise apparatus comprising:

a framework including a front portion and a rear portion;

at least one ramp assembly mounted to said framework, each ramp assembly including a curved configuration;

first and second foot support assemblies, each foot support assembly having a front end and a rear end, each foot support assembly being movably coupled to said at least one ramp assembly; and a flexible coupling mechanism being configured to couple said first foot support assembly to said second foot support assembly, said flexible coupling mechanism including a first cable and pulley system and a second cable and pulley system, said first cable and pulley system configured to adjust an upper terminus and a lower terminus of said first and second foot support assemblies and to couple said front end of each of said first and second foot support assemblies to said front portion of said framework, and said second cable and pulley system configured to couple said rear end of each of said first and second foot support assemblies to said rear portion of said framework, wherein the upper terminus and the lower terminus can be adjusted during exercise without altering the stride length, wherein adjustment of the upper terminus and the lower terminus alters a stride path of said first and second foot support assemblies.

36. The exercise apparatus of claim 35, wherein a resistance assembly is coupled to said first and second foot support assemblies by said flexible coupling mechanism so as to provide resistance against movement of said first and said second foot support assemblies by a user.

37. The exercise apparatus of claim 36, wherein said flexible coupling mechanism comprises:

a pair of front cables, each front cable being attached at one end to a respective one of said first and second foot support assemblies, and an opposite end of each of said front cables being attached to a respective drive pulley of a pair of drive pulleys; and a capstan cable attached at one end to one of said drive pulleys, said capstan cable being coupled to a capstan, and an opposite end of said capstan cable being attached to the other of said pair of drive pulleys.

38. The exercise apparatus of claim 35, wherein the effective length of said flexible coupling mechanism is adjustable so as to adjust a maximum stride length of said foot support assemblies.

39. The exercise apparatus of claim 38, wherein a foot location control assembly adjusts the effective length of said flexible coupling mechanism.

40. The exercise apparatus of claim 39, wherein the termini of movement of each foot support assembly is determined by the position of said foot location control assembly such that a user may select a position for said foot location control assembly corresponding to a substantially vertical portion of said at least one ramp assembly, a substantially horizontal portion of said ramp assembly, or any position therebetween.

41. The exercise apparatus of claim 39, wherein each foot support assembly includes a foot support platform, a foot platform bracket pivotally connected to said foot support platform, and a spring loaded drum pulley configured to maintain tension within said at least one cable so as to draw in any cable slack.

42. The exercise apparatus of claim 37, further comprising a lower cable attached at one end to a respective one of said first and second foot support assemblies, and an opposite end of said lower cable being attached to the other of said foot support assemblies so as to maintain tension within said flexible coupling mechanism.

43. The exercise apparatus of claim 35, further comprising a pair of spaced apart handles, each handle being fixedly attached at a first end to a respective upper pulley, each of said upper pulleys being coupled to a respective one of said first and said second foot support assemblies by said flexible coupling mechanism.

44. The exercise apparatus of claim 35, wherein said at least one ramp assembly, said flexible coupling mechanism, and said foot support assemblies are configured to provide a stride length of at least about 30 inches.

45. The exercise apparatus of claim 35, wherein said flexible coupling mechanism connects said first foot support assembly to said second foot support assembly such that movement of said first or said second foot support assembly causes a reciprocal movement of the other of said first and second foot support assemblies.

46. An exercise apparatus comprising:

a framework;

at least one ramp assembly mounted to said framework, said at least one ramp assembly including an upper ramp defining a first curve extending between a first end and a second end of said upper ramp and a lower guide member defining a second curve extending between a first end and a second end of said lower guide member, wherein said lower guide member is positioned below and extends substantially along the length of said upper ramp, wherein said first end of said lower guide member is separated from said first end of said upper ramp by a first distance, and wherein said second end of said lower guide member is separated from said second end of said upper ramp by a second distance, said second distance being greater than said first distance;

a pair of foot support assemblies movably mounted to said at least one ramp assembly, wherein a first foot support assembly of said pair of foot support assemblies is movably coupled to said ramp and said guide member;

wherein a maximum length of the movement of said foot support assemblies is substantially the entire length of said at least one ramp assembly; and wherein a shape of the movement of said foot support assemblies is substantially the shape of said first curve.

47. An exercise apparatus comprising:

a framework;

at least one ramp assembly mounted to said framework, said at least one ramp assembly including a curved configuration;

first and second foot support assemblies, each foot support assembly having a front end and a rear end, each foot support assembly comprising a foot support platform and a foot platform bracket pivotally connected to said foot support platform, each foot support assembly being movably coupled to said at least one ramp assembly;

a resistance and adjustment assembly including a first cable and pulley system interconnecting said front end of said first foot support assembly to said front end of said second foot support assembly so as to provide resistance against movement of said first and second foot support assemblies by a user, said resistance and adjustment assembly adapted to selectively adjust an upper terminus and a lower terminus of said first and second foot support assemblies, wherein the upper terminus and the lower terminus can be adjusted during exercise without altering the stride length, wherein adjustment of the upper terminus and the lower terminus alters a stride path of said first and second foot support assemblies; and a flexible coupling mechanism including a second cable and pulley system linking said rear end of said first foot support assembly to said framework and linking said rear end of said second foot support assembly to said framework.

48. The exercise apparatus of claim 47, wherein said resistance and adjustment assembly is fixed with respect to said framework.

49. The exercise apparatus of claim 47, wherein each end of a cable of said second cable and pulley system is attached to a respective foot support bracket such that said cable is linked at each end to a respective foot support platform via the respective foot support bracket.

50. An exercise apparatus comprising:

a framework comprising a frame and a ramp assembly, said ramp assembly comprising at least one ramp, said at least one curved ramp having a first end and an opposing second end;

a pair of foot support assemblies, wherein each foot support assembly is movably coupled to said ramp assembly; and means for adjusting the neutral body position of a user with respect to a support surface and for selectively adjusting an upper terminus and a lower terminus of each foot support assembly of said pair of foot support assemblies, wherein the upper terminus and the lower terminus can be adjusted during exercise without altering the stride length, wherein adjustment of the upper terminus and the lower terminus alters a stride path of said first and second foot support assemblies.

51. The exercise apparatus of claim 50, wherein said means for adjusting the neutral body position of the user with respect to the support surface comprises an adjustable pulley system coupled to said framework.

52. The exercise apparatus of claim 50, wherein said means for adjusting the neutral body position of the user with respect to the support surface comprises a lead screw.

53. An exercise apparatus comprising:

a framework comprising a frame and a ramp assembly, said ramp assembly comprising at least one ramp, said at least one curved ramp having a first end and an opposing second end;

a pair of foot support assemblies, each foot support assembly being movably coupled to said ramp assembly; and an adjustment assembly configured to selectively alter the neutral body position of a user with respect to a support surface, said adjustment assembly being selectively operable to alter an upper terminus and a lower terminus of each foot support assembly of said pair of foot support assemblies, wherein the upper terminus and the lower terminus can be altered during exercise without altering the stride length, wherein adjustment of the upper terminus and the lower terminus alters a stride path of said first and second foot support assemblies.

54. The exercise apparatus of claim 35, wherein said second cable and pulley system couples said rear end of each of said first and second foot support assemblies to a pulley secured to said rear portion of said framework.

55. The exercise apparatus of claim 35, wherein said second cable and pulley system couples said rear end of each of said first and second foot support assemblies directly to said rear portion of said framework.

56. The exercise apparatus of claim 54, wherein said second cable and pulley system comprises a rear cable that passes through said pulley and is secured at a first end to said first foot support assembly and is secured at a second end to said second foot support assembly.

57. The exercise apparatus of claim 55, wherein said second cable and pulley system comprises a first rear cable that couples said first support assembly directly to said rear portion of said framework, and a second rear cable that couples said second foot support assembly directly to said rear portion of said framework.

58. The exercise apparatus of claim 47, wherein said second cable and pulley system links said rear end of each of said first and second foot support assemblies to a pulley secured to said framework.

59. The exercise apparatus of claim 47, wherein said second cable and pulley system couples said rear end of each of said first and second foot support assemblies directly to said framework.

60. The exercise apparatus of claim 58, wherein said second cable and pulley system comprises a rear cable that passes through said pulley and is secured at a first end to said first foot support assembly and is secured at a second end to said second foot support assembly.

61. The exercise apparatus of claim 59, wherein said second cable and pulley system comprises a first rear cable that couples said first support assembly directly to said framework, and a second rear cable that couples said second foot support assembly directly to said framework.

* * * * *

UNITED STATES PATENT AND TRADEMARK OFFICE

CERTIFICATE OF CORRECTION

PATENT NO. : 7,658,698 B2
APPLICATION NO. : 11/832496
DATED : February 9, 2010
INVENTOR(S) : Pacheco et al.

It is certified that error appears in the above-identified patent and that said Letters Patent is hereby corrected as shown below:

On Title Page 3, Item 56 Right Column

Other Publications, change "www.us.commerciallifefitness.com, "Summit Trainers," printed Oct. 17, 2006 (3 pages)." to --www.us.commercial.lifefitness.com, "Summit Trainers," printed Oct. 17, 2006 (3 pages).--

On Title Page 4, Item 56 Left Column

Other Publications, change "Horizon Series E30 E20, printed on Jul. 27, 2004 from www.horizonfitness.com/horizon-series/ellipticals/e20.php, (1 page)." to --Horizon Series E30 E20, printed on Jul. 27, 2004 from www.horizonfitness.com/horizon-series/ellipticals/e20.php, (1 page).--

Other Publications, change "Internet archive for ocatnefitness.com, "Home Products," available on information and belief at least as early as Jun. 12, 2006 (1 page)." to --Internet archive for ocatnefitness.com, "Home Products," available on information and belief at least as early as Jun. 12, 2005 (1 page).--

On Title Page 4, Item 56 Right Column

Other Publications, change "Internet archive for www.octanefitness.com, pages entitled "Why are elliptical trainers so popular," "Effectiveness of Elliptical Trainerss," Impact your life, not your body! "Total Body Workout," "Minimal Maintenance," "Small Footprint," "Retailers," available on information and belief at least as early as Dec. 31, 2005 (7 pages)." to --Internet archive for www.octanefitness.com, pages entitled "Why are elliptical trainers so popular," "Effectiveness of Elliptical Trainers," "Impact your life, not your body!" "Total Body Workout," "Minimal Maintenance," "Small Footprint," "Retailers," available on information and belief at least as early as Dec. 31, 2005 (7 pages).--

Signed and Sealed this
Eleventh Day of September, 2012

David J. Kappos

David J. Kappos
*Director of the United States Patent and Trademark Office*

Drawings

Sheet 1, replace Figure 1 with the figure depicted below, wherein the second instance of "102" has been removed Sheet 6, replace Figure 5A with the figure depicted below, wherein the lower wheels "228" and "230" have been correctly labeled Sheet 6, replace Figure 5B with the figure depicted below, wherein the lower wheels "228" and "230" have been correctly labeled, and the foot platform bracket has been changed from "206" to --216--

Sheet 17, replace Figure 11A with the figure depicted below, wherein the assembly has been changed from “300” to --300'--

Column 1
Line 10, insert an --”-- after “ASSEMBLY,”

Column 3
Line 23, change “having” to --have--

Column 4
Line 15, delete “and”

Column 6
Line 59, change “is” to --as--

Column 8
Line 34, change “create” to --to create--

Column 11
Line 20, delete the first instance of “each”

Column 12
Line 44, change “each” to --each of--

Column 13
Line 65, change “FIG.” to --FIGS.--

Column 14
Line 19, delete “as”
Line 24, insert a --,-- after “example”
Line 33, delete “an”

Column 16
Line 5, change “with” to --which--
Line 10, change “alternative” to --an alternative--
Line 15, change “breaking” to --braking--
Line 17, change “breaking” to --braking--
Line 19, change “breaking” to --braking--
Line 28, change “illustrated” to --illustrative--